US007492342B2

(12) United States Patent
Aoki

(10) Patent No.: US 7,492,342 B2
(45) Date of Patent: Feb. 17, 2009

(54) ELECTRO-OPTICAL DEVICE, DRIVING CIRCUIT OF THE SAME, DRIVING METHOD OF THE SAME, AND ELECTRONIC APPARATUS

(75) Inventor: Toru Aoki, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 674 days.

(21) Appl. No.: 11/094,233

(22) Filed: Mar. 31, 2005

(65) Prior Publication Data

US 2006/0007208 A1 Jan. 12, 2006

(30) Foreign Application Priority Data

Jun. 29, 2004 (JP) ..... 2004-192001

(51) Int. Cl.
*G09G 3/36* (2006.01)

(52) U.S. Cl. ..... 345/99

(58) Field of Classification Search ..... 345/204, 345/690–691, 94, 99, 87–89; 349/1, 33, 349/54

See application file for complete search history.

(56) References Cited

U.S. PATENT DOCUMENTS 6,300,807 B1 10/2001 Miyazaki et al.
6,489,824 B2 12/2002 Miyazaki et al.
2003/0151713 A1 * 8/2003 Aoki ..... 349/149

FOREIGN PATENT DOCUMENTS

| | | |
|---|---|---|
| JP | A-6-204792 | 7/1994 |
| JP | A-2000-298532 | 10/2000 |
| JP | A-2003-66888 | 3/2003 |
| JP | A-2003-157063 | 5/2003 |
| JP | A-2003-157064 | 5/2003 |

* cited by examiner

*Primary Examiner*—Chanh Nguyen
*Assistant Examiner*—Allison Walthall
(74) *Attorney, Agent, or Firm*—Oliff & Berridge, PLC

(57) ABSTRACT

The electro-optical device having a driving circuit that detects the phase difference between a monitoring signal supplied in synchronization with a data signal and a reference pulse supplied in synchronization with an enable pulse. The driving circuit outputs the result as a phase difference signal. A first phase adjusting circuit roughly adjusts and a second phase adjusting circuit minutely adjusts the phase of the enable pulse. An adjustment control circuit, when the phase of the monitoring signal is delayed with respect to the reference pulse, controls the first circuit to advance the phase of the enable pulse and controls the second circuit to minutely adjust the phase to minimize the difference. When the phase of the monitor signal precedes that of the reference pulse, the adjustment control circuit controls the first circuit to delay the phase of the enable pulse and controls the second circuit to minutely adjust the phase to minimize the difference.

9 Claims, 12 Drawing Sheets

ELECTRO-OPTICAL DEVICE, DRIVING CIRCUIT OF THE SAME, DRIVING METHOD OF THE SAME, AND ELECTRONIC APPARATUS

BACKGROUND OF THE INVENTION

1. Technical Field

The present invention relates to an electro-optical device, a driving circuit of the same, a driving method of the same, and an electronic apparatus capable of preventing the deterioration of display quality.

2. Related Art

In recent years, a reduced image is formed by a display panel using, for example, liquid crystal, and projectors for projecting the reduced image onto a screen or a wall surface by an optical system have become widespread. The projector does not have a function for forming an image as is and is supplied with image data (or image signals) from a host device, such as a personal computer or a television tuner. Since the image data designates the gray-scale level (brightness) of a pixel and is supplied in a vertical and horizontal scanning manner to the pixels arranged in a matrix, it is preferable that the panel used for the projector be driven in the above-mentioned manner. As a result, the panel used for the projector is generally of a point-sequential type in which the scanning lines are sequentially selected, the data lines are sequentially selected for a period of time when one scanning line row is selected (one horizontal scanning period) and data signals supplied to an image signal line are sampled to the selected data line. Here, the data signal is a signal obtained by properly converting the image data so as to be suitable for driving the liquid crystal.

In addition, in order to cope with a high-definition display image, a driving method called a phase expansion driving method has been considered. During one horizontal scanning period, the phase expansion driving method simultaneously selects a predetermined number of data lines belonging to each group, for example, six lines belonging to one block, and expands the image signal to be supplied to the pixel corresponding to the intersection of the selected scanning lines and the selected data lines by six times along the time axis to respectively sample them to the six data lines corresponding to the selected block.

In both the point-sequential method and the phase expansion method, the same manner is used for sampling the data signal to the data lines.

Here, the data lines are selected by the sampling signal (pulse). Specifically, sampling switches are provided between the image signal line and each data line, and the data signal is sampled to the data lines when the sampling switch is turned on according to the sampling signal. According to this structure, when the pulse widths of the sampling signals corresponding to adjacent data lines (block) overlap with each other, a different data signal from the original data signal is sampled, so that display quality is deteriorated.

Further, in recent years, there has been proposed a technique in which the pulse width of the sampling signal is made smaller by an enable pulse, and the sampling signals output before and after the phase in time do not overlap each other.

Since the panel has a structure in which transistors and various wiring lines are formed on a substrate made of, for example, glass, it is easy for a parasitic capacitor to generate a signal delay due to the wiring resistance. In particular, since a supply path of the enable pulse is different from that of the data signal, although the enable pulse is supplied to the panel so as to be synchronized with the data signal, in the panel, the phase of the enable pulse is deviated with respect to the data signal, so that it is not possible to generate suitable sampling signals.

In order to solve the above-mentioned problems, there has been disclosed a technology in which the monitoring signal supplied in synchronization with the enable pulse is supplied to the panel, the delayed or advanced deviation in the panel is detected, the phase of the enable pulse is adjusted according to the deviation, and the phase deviation of the enable pulse is changed.

In this technology, the phase adjustment is performed by inputting the master clock signal to the delay circuits connected in a cascaded manner, by selecting any one of the outputs of the delay circuits according to the delay time of the enable pulse, and by generating the enable pulse based on the selected master clock signal.

However, since the phase deviation of the enable pulse degrades the display quality, it is preferable that the precision of the phase adjustment be improved as much as possible. In this technology, since the minimum adjustment unit of the phase of the enable pulse depends on the delay time in each delay circuit, shortening the delay time in the delay circuit improves the adjustment precision. However, when the delay time in the delay circuit is short, the phase adjustment range of the enable pulse is narrowed, so that it is difficult to cope with the deviation of the enable pulse. On the other hand, in order to improve the phase adjustment precision of the enable pulse and to ensure the phase adjustment range, it is necessary that a plurality of delay circuits be connected to each other in a cascaded manner. As a result, there is a problem in that the structure becomes complicated.

SUMMARY

An advantage of the invention is that it provides an electro-optical device, a driving circuit of the same, a driving method of the same, and an electronic apparatus capable of preventing the deterioration of display quality with a simple structure.

According to a first aspect of the invention, there is provided a driving circuit of an electro-optical device, the electro-optical device having a plurality of pixels which are provided to correspond to intersections of a plurality of scanning lines and a plurality of data lines and which display the gray-scale levels corresponding to data signals sampled to the data lines when the scanning lines and the data lines are selected; a scanning line driving circuit which selects the scanning lines; shift registers which generate pulse signals for selecting the data lines for a period of time when the scanning lines are selected; a logical circuit which restricts the pulse signals respectively generated by the shift registers to the pulse width of an enable pulse to output them as sampling signals; and a sampling circuit which samples the data signals to the data lines according to the sampling signals, the driving circuit including: a phase difference detecting circuit which detects the phase difference between a monitoring signal supplied in synchronization with the data signal and a reference pulse supplied in synchronization with the enable pulse and which outputs the detected result as a phase difference signal; a first phase adjusting circuit which roughly adjusts the phase of the enable pulse supplied to the logical circuit; a second phase adjusting circuit which minutely adjusts the phase of the enable pulse supplied to the logical circuit with higher precision than the first phase adjusting circuit; and an adjustment control circuit which, when the phase difference signal indicates that the phase of the monitoring signal is delayed with respect to the reference pulse, controls the first phase adjusting circuit to advance the phase of the enable pulse and then controls the second phase adjusting circuit to minutely adjust the phase of the enable pulse such that the phase difference indicated by the phase difference signal is minimum, and which, when the phase difference signal indicates that the phase of the monitor signal precedes that of the reference pulse, controls the first phase adjusting circuit to delay the phase of the enable pulse and then controls the second phase adjusting circuit to minutely adjust the phase of the enable pulse such that the phase difference indicated by the phase difference signal is minimum. According to this driving circuit, since the phase of the enable pulse is roughly adjusted by the first phase adjusting circuit and is minutely adjusted by the second phase adjusting circuit, the adjustment precision of the phase is improved, and a necessary adjustment range is ensured. Therefore, it is possible to achieve a simple structure and to prevent the deterioration of display quality.

In the driving circuit of the electro-optical device according to the first aspect, the adjustment control circuit preferably controls the first phase adjusting circuit to perform the rough adjustment during a retrace period when neither the scanning lines nor the data lines are selected. In this structure, the rough adjustment by the first phase adjusting circuit is performed during the retrace period not having an influence on display. Therefore, it is difficult to perceive the deterioration of display quality caused by the rough adjustment.

In the driving circuit of the electro-optical device according to the first aspect, the adjustment control circuit controls the first phase adjusting circuit to perform the rough adjustment for a predetermined period after power is supplied. In this case, it is difficult to perceive the deterioration of display quality caused by the rough adjustment.

Further, it is preferable that the precision of the minute adjustment by the second phase adjusting circuit be two or more times that of the rough adjustment by the first phase adjusting circuit.

However, when a phase adjustment point in the second phase adjusting circuit leans to one side after the rough adjustment by the first phase adjusting circuit is performed, problems which can not be resolved by only the minute adjustment by the second phase adjusting circuit may arise. Therefore, it is preferable that, when controlling the first phase adjusting circuit to perform the rough adjustment, the adjustment control circuit controls the second phase adjusting circuit such that the phase adjustment point is approximately at the center of an adjustment range.

Further, it is preferable that the monitoring signal and the reference pulse be generated in synchronization with each other. In addition, it is preferable that the sampling signal be supplied in synchronization with a clock signal, and that the reference pulse be supplied in synchronization with the clock signal in a horizontal retrace period.

Furthermore, the conception of the invention can be applied to a driving method of the electro-optical device and an electronic apparatus, in addition to the driving circuit of the electro-optical device. In addition, since the electronic apparatus has the electro-optical device, the electronic apparatus can have a simple structure and prevent the deterioration of display quality.

BRIEF DESCRIPTION OF THE DRAWINGS

The invention will be described with reference to the accompanying drawings, wherein like numbers refer to like elements, and wherein.

DESCRIPTION OF THE EMBODIMENTS

Figure 1:
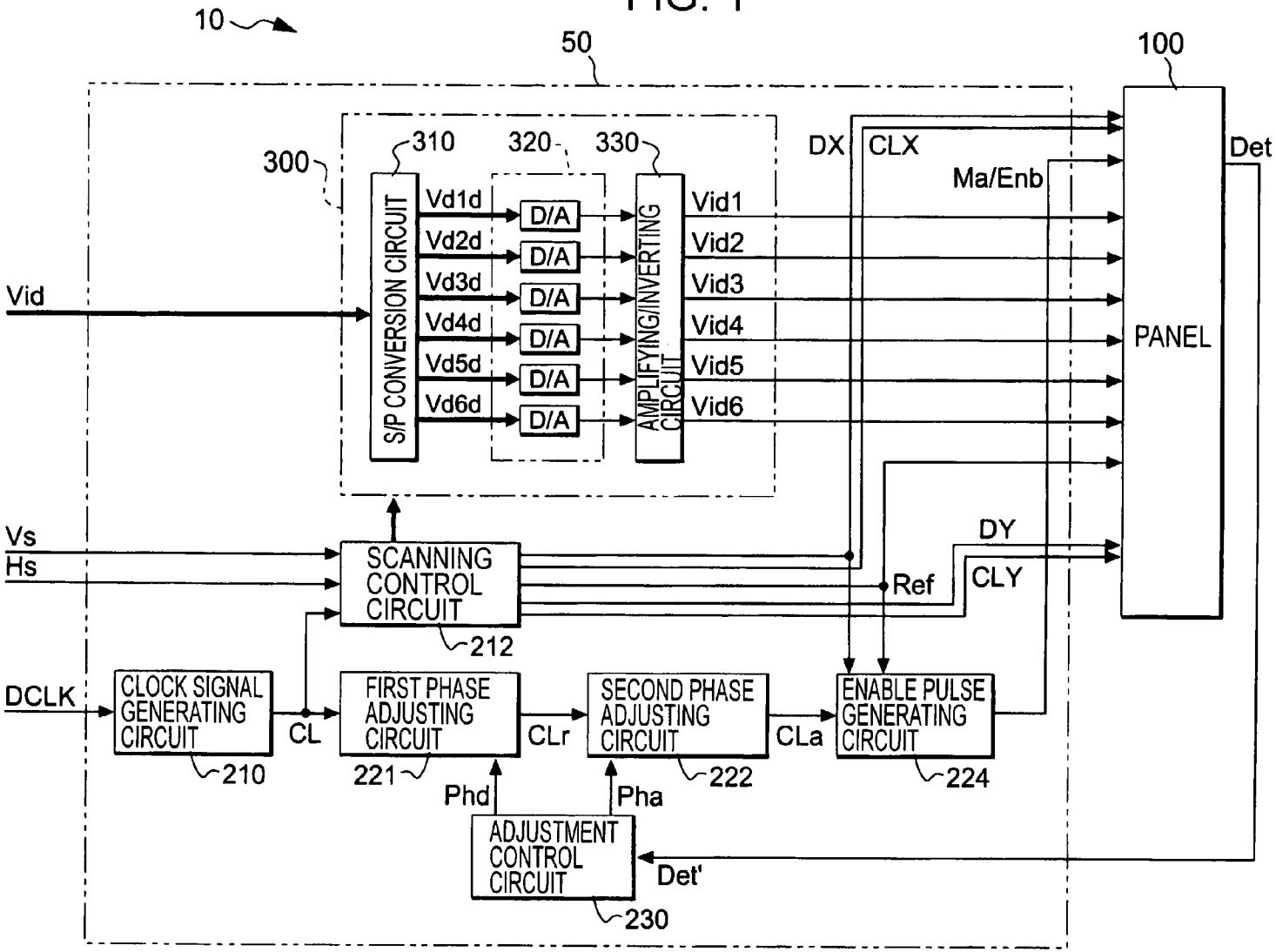
FIG. 1 is a block diagram showing the structure of an electro-optical device according to an embodiment of the present invention.

Hereinafter, embodiments of the present invention will be described with reference to the accompanying drawings. FIG. 1 is a block diagram showing the overall structure of an electro-optical device according to an embodiment of the present invention.

As shown in FIG. 1, an electro-optical device 10 is divided roughly into a processing circuit 50 and a panel 100. The processing circuit 50 is a circuit module formed on a printed substrate, and is connected to the panel 100 by an FPC (flexible printed circuit) substrate or the like, so that it supplies various signals and receives a monitoring signal, which will be described later.

The processing circuit 50 includes a clock signal generating circuit 210, a scanning control circuit 212, a first phase adjusting circuit 221, a second phase adjusting circuit 222, an enable pulse generating circuit 224, an adjustment control circuit 230, and a data signal supplying circuit 300.

The data signal supplying circuit 300 has an S/P conversion circuit 310, a D/A converting circuit group 320, and an amplifying/inverting circuit 330. Among them, the S/P conversion circuit 310 is synchronized with a vertical scanning signal Vs, a horizontal scanning signal Hs, and a dot clock signal DCLK, distributes digital image data Vid supplied from a host device (not shown) to six channels, and extends each digital image data distributed to the six channels by six times along the time axis (which is called serial-to-parallel conversion or phase expansion) to output them as image data Vd1*d* to Vd6*d*.

Here, the image data Vid is data for designating the gray-scale level (brightness) of a pixel. In detail, the image data Vid designates the gray-scale level of the pixel horizontally scanned in a horizontal effective display period during the horizontal effective display period and designates the pixel at the lowest gray-scale level (black) during a horizontal retrace period.

In addition, the reason for designating the pixel at the lowest gray-scale level during the horizontal retrace period is that the pixel does not contribute to display although the image data is supplied to the pixel due to the timing deviation. In addition, the reason for serial-to-parallel-converting the image data Vid is to ensure the sample/hold time and charging/discharging time by making the time when the data signal is applied longer in a sampling switch, which will be described in detail later.

The D/A converting circuit group 320 is an aggregate of D/A converters provided for each channel and converts each of the image data Vd1*d* to Vd6*d* into an analog signal having a voltage according to the gray-scale level of each pixel.

The amplifying/inverting circuit 330 inversely or normally converts the polarities of the analog-converted signals based on a voltage Vc to suitably amplify them and then supplies them to the panel 100 as data signals Vid1 to Vid6.

The inversion of polarity may be performed (a) for each scanning line, (b) for each data line, (c) for each pixel, and (d) for each screen (frame). In the present embodiment, the inversion of polarity is made (a) for each scanning line (1H inversion). However, the invention is not limited thereto.

Figure 11:
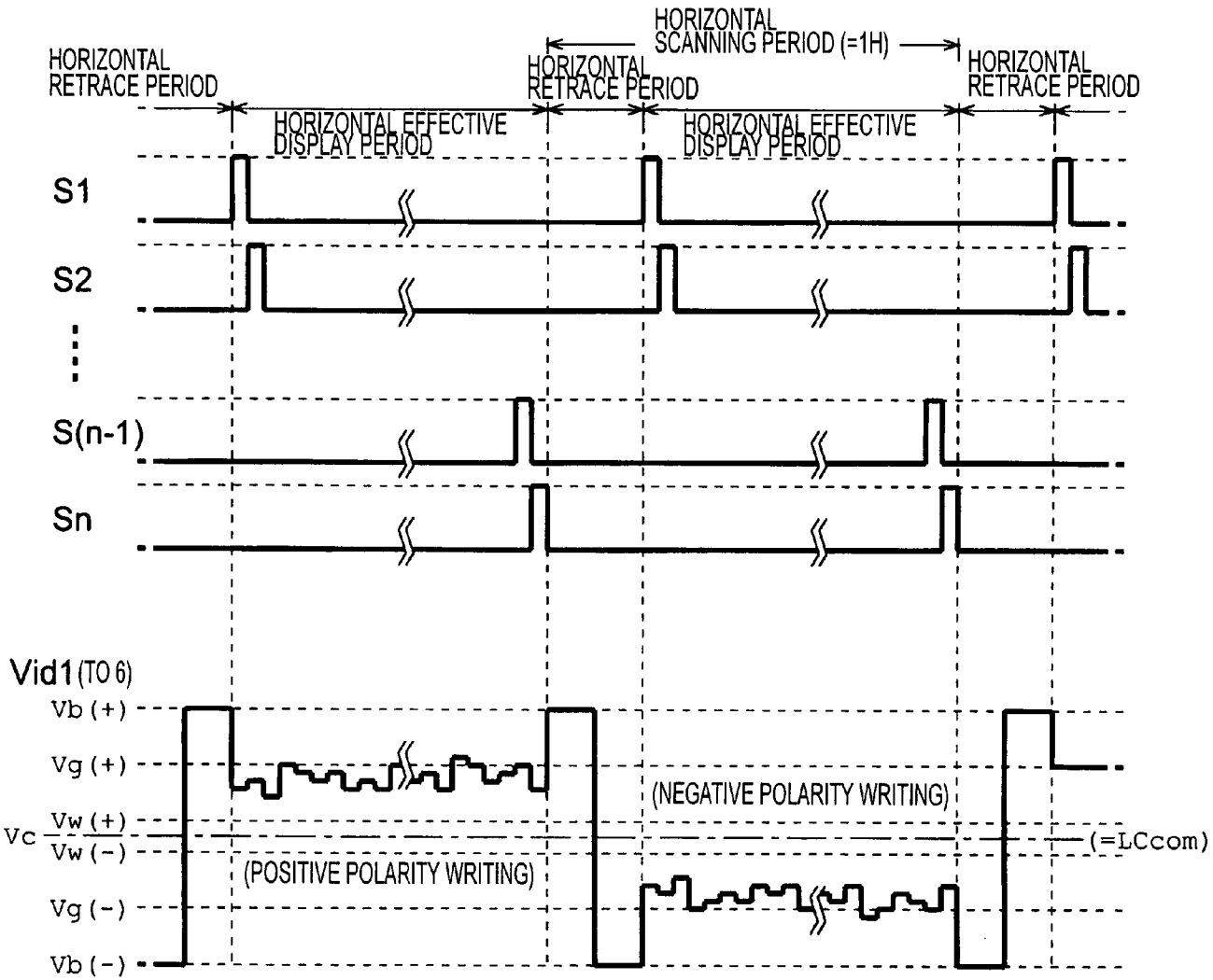
FIG. 11 is an explanatory view illustrating the display operation of the electro-optical device.

In addition, the voltage Vc is a voltage of an amplitude center of the image signal as shown in FIG. 11 and is substantially equal to a voltage LCcom applied to a counter electrode. Further, for the sake of convenience, a voltage higher than the voltage of the amplitude center and a voltage lower than the voltage of the amplitude center are referred to as a voltage having a positive polarity and a voltage having a negative polarity, respectively.

In addition, in the present embodiment, after the video data Vid is serial-to-parallel converted, it is converted into the analog signal. However, the video data Vid may be converted into the analog signal before it is serial-to-parallel converted.

Figure 2:
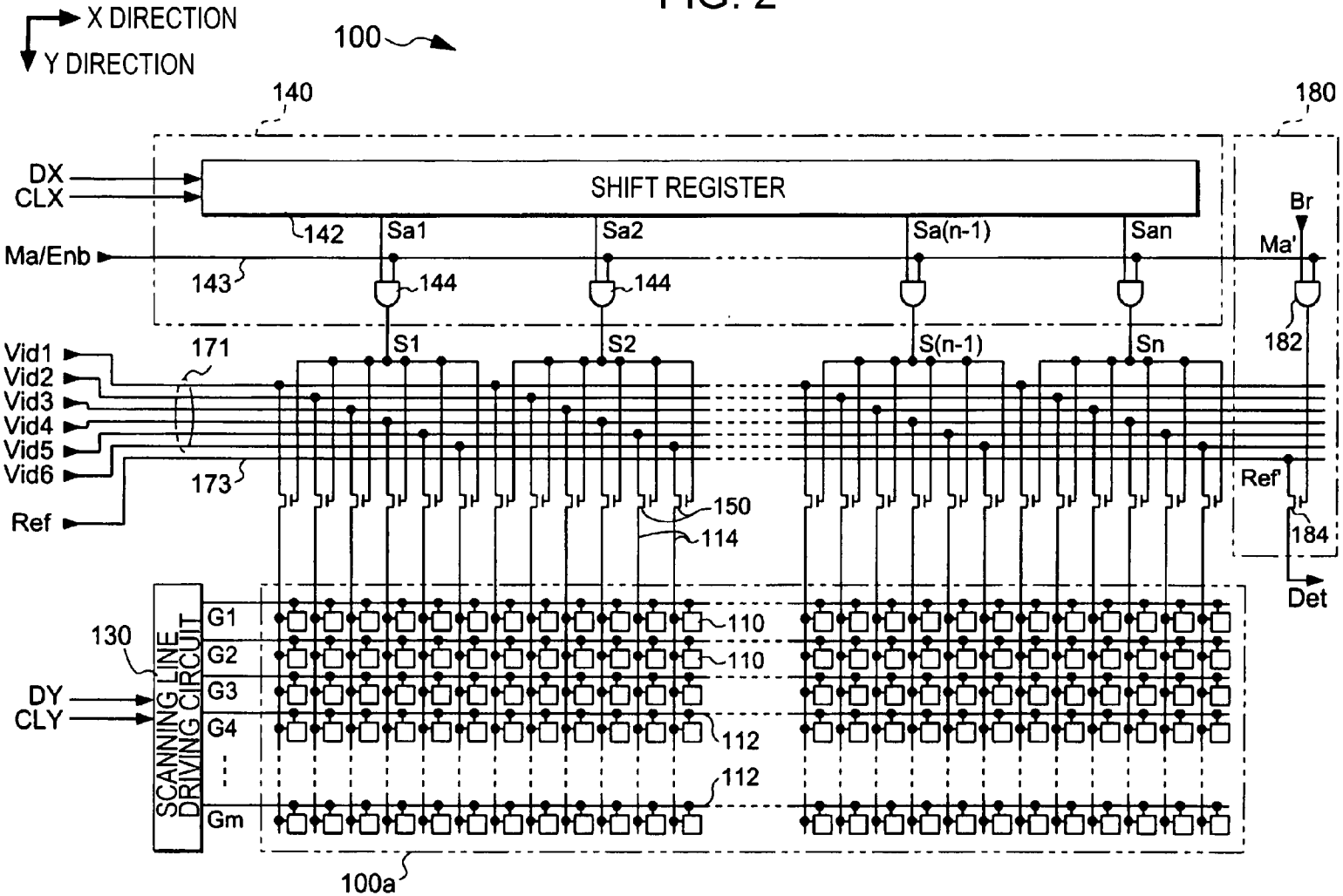
FIG. 2 is a diagram showing the structure of a panel in the electro-optical device.
Figure 3:
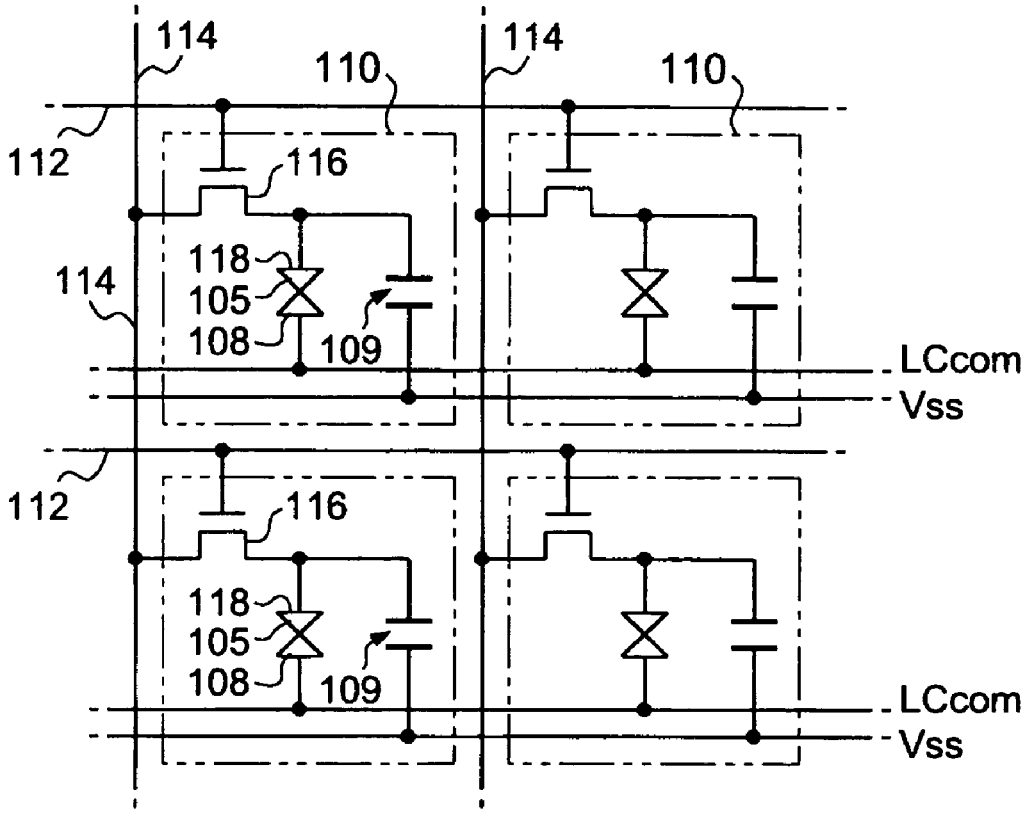
FIG. 3 is a diagram showing the structure of pixels in the panel of the electro-optical device.

Here, the structure of the panel 100 will be described. The panel 100 functions to form a predetermined image by means of an electro-optical change, and FIG. 2 is a block diagram showing the electrical structure of the panel 100. In addition, FIG. 3 is a diagram showing the detailed structure of pixels of the panel 100.

As shown in FIG. 2, in the panel 100, a plurality of scanning lines 112 is arranged in the horizontal direction (X direction), and a plurality of data lines 114 is arranged in the vertical direction (Y direction). In addition, a plurality of pixels 110 are provided to correspond to intersections of the scanning lines 112 and the data lines 114, thereby constituting a display region 100*a*.

According to the present embodiment, it is assumed that the number of the scanning lines 112 (the number of rows) is 'm', the number of the data lines 114 (the number of columns) is '6n' (a multiple of 6), and that the pixels 110 are arranged in a matrix of m rows by 6n columns.

Six image signal lines 171 are respectively supplied with the data signals Vid1 to Vid6 by the amplifying/inverting circuit 330.

One end of each data line 114 is provided with a sampling switch 150 for sampling each of the data signals Vid1 to Vid6 supplied to the image signal lines 171 to the data line 114. According to the present embodiment, each sampling switch 150 is an n channel-type thin film transistor (hereinafter, referred to as a TFT) which has a drain connected to the data line 114 and a gate commonly connected to the six data lines 114 functioning as one unit.

Here, the data lines 114 to which the gate of the sampling switch 150 is commonly connected are considered as one block. In addition, in the case of considering such a block, the sampling switch 150 whose drain is connected to one end of a j-th column of data lines 114 by counting the data lines from the left side of FIG. 2 has a source connected to the image signal line 171 to which the data signal Vid1 is supplied when a remainder obtained by dividing j by 6 is '1'. Similarly, sampling switches whose drains are connected to one end of each of the data lines 114 that remainders obtained by dividing j by 6 are '2', '3', '4', '5', and '0' have sources connected to the image signal lines 171 to which the data signals Vid2 to Vid6 are supplied, respectively. For example, the sampling switch 150 whose drain is connected to one end of the eleventh-column data line 114 by counting the data lines from the left side of FIG. 2 has a source connected to the image signal line 171 to which the data signal Vid5 is supplied because a remainder obtained by dividing '11' by 6 is '5'. In addition, 'j' is a reference numeral for describing the data line 114 and is an integer satisfying $1 \leqq j \leqq 6n$.

Figure 9:
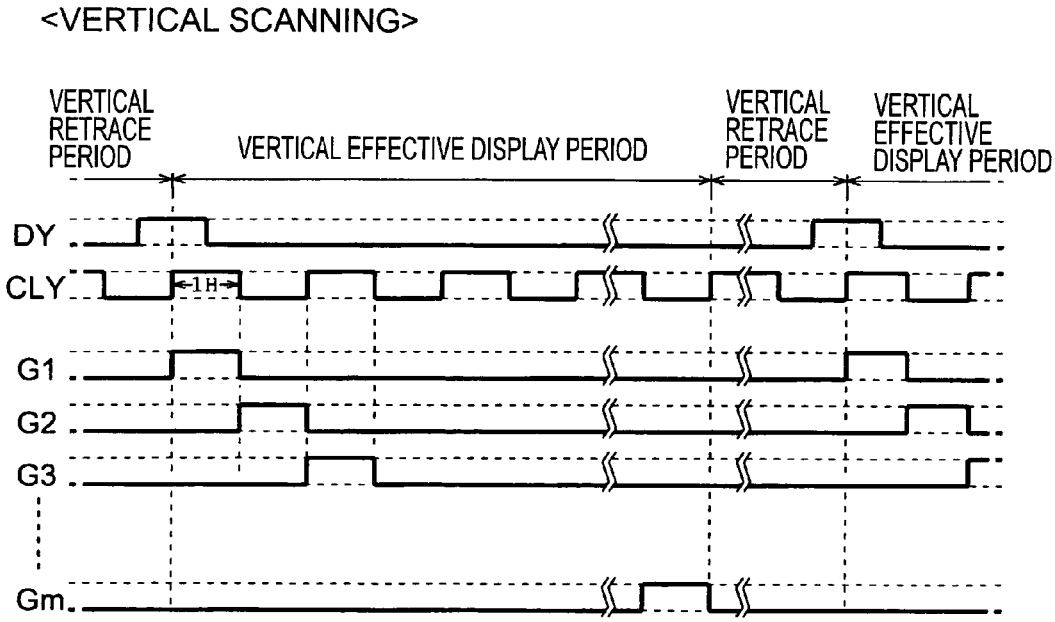
FIG. 9 is a timing chart illustrating a display operation of the electro-optical device.

As shown in FIG. 9, a scanning line driving circuit 130 receives a transmission start pulse DY supplied at the beginning of the vertical effective display period at the timing when the level of a clock signal CLY is shifted (rising and falling), sequentially shifts it, and outputs it sequentially and exclusively as scanning signals G1, G2, . . . , and Gm, which become H levels by the horizontal scanning period (1H). In addition, since the detailed description of the scanning line driving circuit 130 is not associated with the invention, the description thereof will be omitted.

Figure 10:
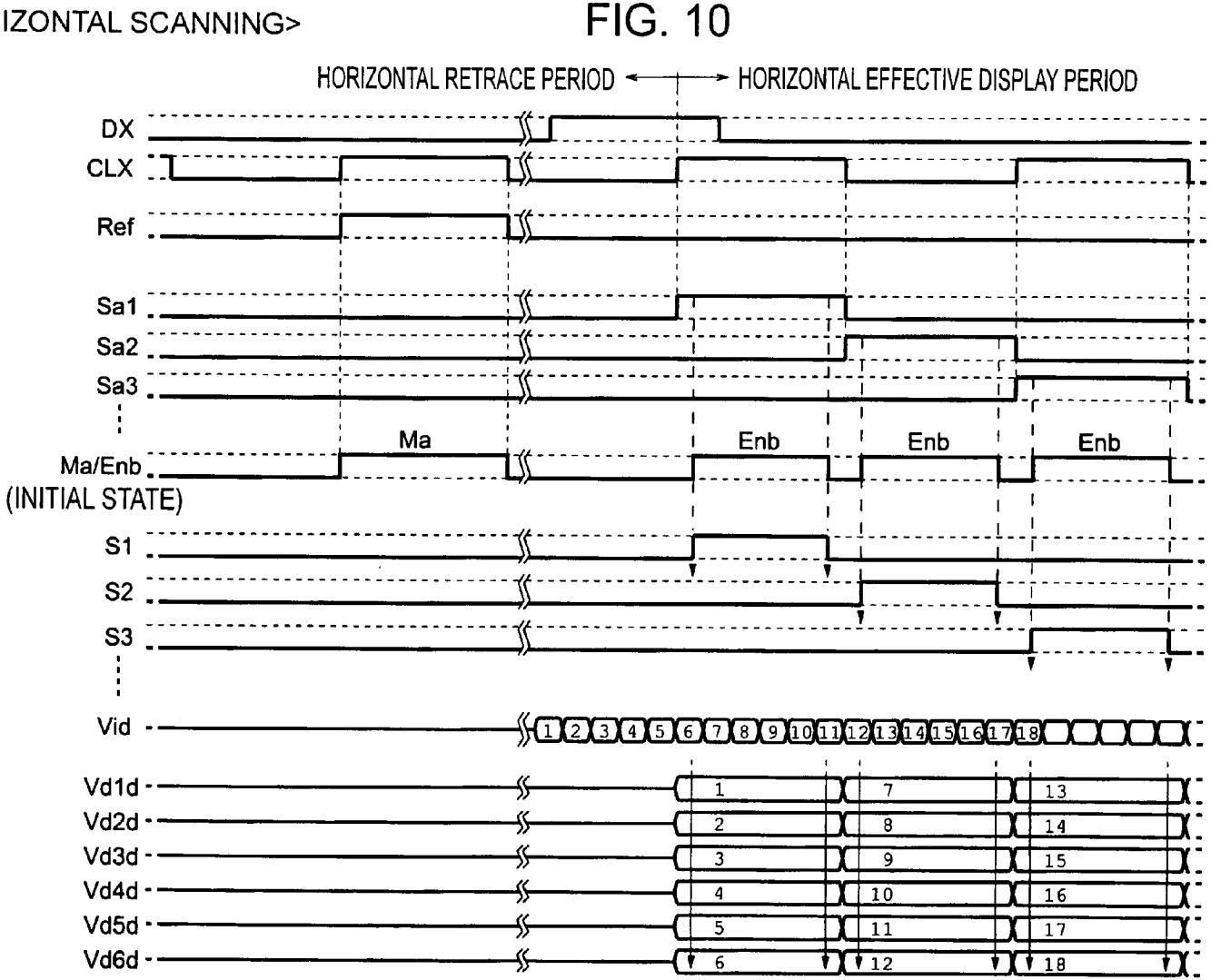
FIG. 10 is a timing chart illustrating the display operation of the electro-optical device.

In addition, a block selecting circuit 140 has a shift register 142 and AND circuits 144. As shown in FIG. 10, the shift register 142 receives a transmission start pulse DX supplied at the beginning of the horizontal effective display period at the timing when the level of a clock signal CLX is shifted, sequentially shifts it, and outputs it as signals Sa1, Sa2, Sa3, . . . , Sa (n-1), and San.

The AND circuits 144 are provided at each output state of the shift register 142 to calculate AND signals between the signals supplied from the corresponding output stages and a signal Ma/Enb supplied through the pulse signal line 143, and output them as sampling signals S1, S2, S3, . . . , and Sn.

As shown in FIG. 10, the signal Ma/Enb is a signal which becomes a monitoring pulse Ma during the horizontal retrace period and which becomes an enable pulse Enb during the horizontal effective display period. The enable pulse Enb is generated by an enable pulse signal generating circuit, which will be described later, such that a pulse width becoming the H level is narrower than the half cycle of the clock signal CLX.

For this reason, during the horizontal effective display period, the pulse widths of the signals Sa1, Sa2, . . . , Sa(n-1), and San output by the shift register 142 become narrower, so that they are output as the sampling signals S1, S2, S3, . . . , and Sn.

In addition, these sampling signals S1, S2, S3, . . . , and Sn are commonly supplied to the gates of the sampling switches corresponding to blocks of data lines 114 in FIG. 2. For example, since a second block when counting the data lines from the left side of the figure corresponds to the seventh to twelfth data lines 114, the sampling signal S2 is commonly supplied to the gates of the sampling switches 150 corresponding to these data lines 114.

In addition, according to the present embodiment, the TFT constituting the sampling switch 150 is an n-channel type. However, the TFT constituting the sampling switch 150 may be a p-channel type and may be a complementary TFT obtained by combining an n-channel-type TFT with a p-channel-type TFT.

In the present embodiment, a monitoring signal line 173 is provided so as to be adjacent to and parallel to the image signal lines 171 supplied with the data signals Vid1 to Vid6.

In addition, it is preferable that the monitoring signal line 173 be formed according to the same conditions as the image signal line 171 (the same material, length, width and the like).

One end of the monitoring signal line 173 functioning as an input terminal is supplied with a reference pulse Ref described below, and the other end of the monitoring signal line 173 is connected to a phase difference detecting circuit 180. The phase difference detecting circuit 180 has an AND circuit 182 and a TFT 184. In addition, the AND circuit 182 has the same structure as the AND circuit 144, and the TFT 184 has the same structure as the sampling switch 150.

Specifically, one of the input terminals of the AND circuit 182 is connected to a side (end) opposite to an input side of the pulse signal line 143, and the other of the input terminals of the AND circuit 182 is supplied with a signal Br which becomes an H level only during the horizontal retrace period. In addition, the TFT 184 is an n channel-type TFT, similar to the sampling switch 150, and has a gate connected to an output terminal of the AND circuit 182, a source connected to the other end of the monitoring signal line 173, and a drain having a drain signal to be fed back to the process circuit 50 as a monitoring signal Det.

Next, the pixel 110 will be described.

As shown in FIG. 3, in the pixel 110, an n channel-type TFT 116 has a source connected to the data line 114, a drain connected to a pixel electrode 118, and a gate connected to the scanning line 112.

In addition, a counter electrode 108 is commonly provided with respect to all the pixels so as to face the pixel electrode 118 and is maintained to have a constant voltage LCcom. Further, a liquid crystal layer 105 is interposed between the pixel electrodes 118 and the counter electrode 108. As a result, a liquid crystal capacitor that is composed of the pixel electrode 118, the counter electrode 108, and the liquid crystal layer 105 is formed for each pixel.

Although not shown, on the facing surfaces of both substrates, alignment films subjected to a rubbing process are respectively provided such that the major axial directions of the liquid crystal molecules are continuously twisted by about 90 degrees between both substrates, and on back surface sides of the substrates, polarizers are respectively provided according to the alignment direction.

When the effective value of the voltage applied to the liquid crystal layer 105 is zero, the light passing between the pixel electrode 118 and the counter electrode 108 is rotated by 90 degrees according to the twisted liquid crystal molecules. On the other hand, when the effective voltage value increases, the liquid crystal molecules are inclined in the direction of an electrical field, so that the rotation of light is removed. For this reason, for example, in a transmissive liquid crystal display device, in the case in which the polarizers whose polarization axes are orthogonal to each other according to the alignment direction are provided at the incident and back surface sides of the substrate, if the corresponding effective voltage value approaches zero, the transmittance of light becomes maximum, which results in white display. On the other hand, when the effective voltage value increases, the transmittance of light decreases, which results in black display in which the transmittance is minimum (normally-white mode).

In addition, a storage capacitor 109 is provided for each pixel to prevent electric charge in the liquid crystal capacitor from leaking. One end of the storage capacitor 109 is connected to the pixel electrode 118 (drain of the TFT 116), and the other end thereof is electrically commonly connected to the ground over all the pixels.

In addition, in the pixel 110, the TFT 116 is formed by the same manufacturing process together with constituent elements of the scanning line driving circuit 130, the shift register 142, the AND circuit 144, and the sampling switch 150, which contributes to the small size and low cost of the entire device.

Referring to FIG. 1 again, the clock signal generating circuit 210 generates a signal synchronizing with the dot clock signal DCLK supplied from a host device and generates a master clock signal CL for controlling the synchronization of each unit. In addition, since the present embodiment has the six-phase expansion structure, the frequency of the master clock signal CL is one-sixth of the frequency of the dot clock signal DCLK.

From the master clock signal CL, the vertical scanning signal Vs, and the horizontal scanning signal Hs, the scanning control circuit 212 generates the transmission start pulse DX and the clock signal DLX to control the horizontal scanning by the block selecting circuit 140, and generates the transmission start pulse DY and the clock signal CLY to control the vertical scanning by the scanning line driving circuit 130. In the present embodiment, the master clock signal CL is used as the clock signal CLX as is.

As shown in FIG. 10, the scanning control circuit 212 outputs the reference pulse Ref having a pulse width which is half the value of the clock signal CLX in synchronization with the period in which the corresponding clock signal CLX becomes an H level during the horizontal retrace period.

Although not shown, when outputting the reference pulse Ref, the scanning control circuit 212 notifies an adjustment control circuit 230, which will be described later, of the purport that the reference pulse Ref is output and outputs the transmission start pulse DX to notify the adjustment control circuit 230 whether it is in the horizontal scanning period or not. In addition, the scanning control circuit 212 controls the operation of the phase expansion or the operation of the polarity inversion in the data signal supplying circuit 300 according to the control of the vertical scanning and the horizontal scanning.

The first phase adjusting circuit 221 roughly adjusts the phase of the master clock signal CL to output it as a signal CLr under the control of the adjustment control circuit 230. The second phase adjusting circuit 222 minutely adjusts the phase of the signal CLr to output it as a signal CLa under the control of the adjustment control circuit 230. The enable pulse generating circuit 224 generates an enable pulse Enb based on the signal CLa whose phase is adjusted. Specifically, when the transmission start pulse DX is supplied to the enable pulse generating circuit 224, the enable pulse generating circuit 224 generates the enable pulse Enb such that the pulse width of the H level is narrower than half the cycle of the clock signal CLa, and such that the interval where it becomes the L level includes the rising or falling portion of the clock signal CLa, and stops generating the enable pulse Enb when reaching the horizontal retrace period.

However, when the reference pulse Ref is output by the scanning control circuit 212 during the horizontal retrace period, the corresponding reference pulse Ref functioning as the monitoring pulse Ma is output instead of the enable pulse Enb.

Therefore, when the output from the process circuit 50 is made, the reference pulse Ref and the monitoring pulse Ma are output at the same timing.

Next, the structure of the first phase adjusting circuit 221 will be described with reference to FIG. 4.

Figure 4:
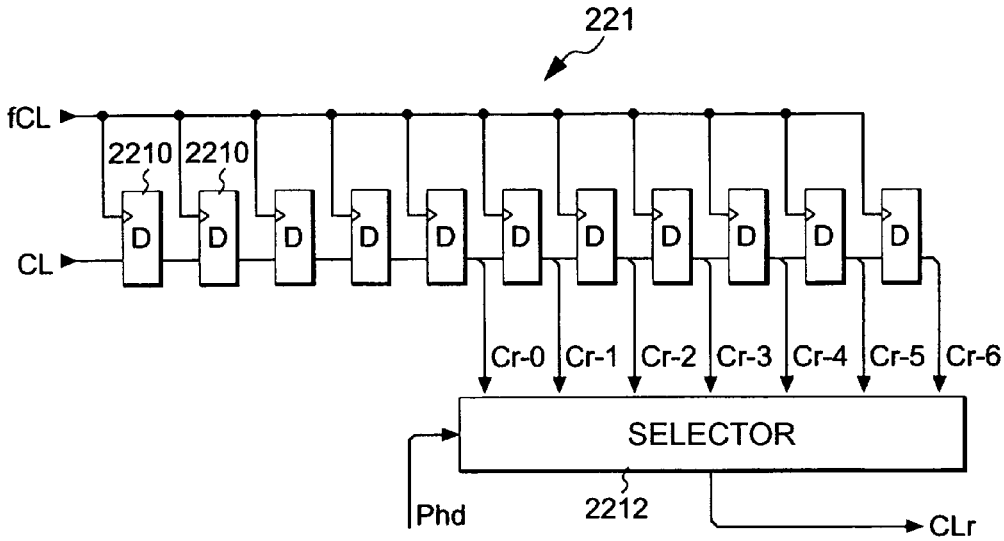
FIG. 4 is a diagram showing the structure of a first phase adjusting circuit in the electro-optical device.

In FIG. 4, each of delay circuits (D) 2210 delays the input signal by one cycle of a clock signal fCL to output it. According to the present embodiment, the delay circuits are connected to each other in a cascaded manner by eleven stages such that the output signal of the delay circuit 2210 located in a certain stage becomes the input signal of the delay circuit 2210 located in the next stage.

In the cascaded connection, an input terminal of a first stage of delay circuit 2210 is supplied with the master clock signal CL by the clock signal generating circuit 210. In addition, the output signals of the delay circuits 2210 in the fifth to eleventh stages are output respectively as signals Cr-0 to Cr-6 and are supplied to a selector 2212.

The selector 2212 selects any one of the signals Cr-0 to Cr-6 according to a control signal Phd by the adjustment control circuit 230 and supplies it to the second phase adjusting circuit 222 as the signal CLr. In addition, in an initial state, the selector 2212 selects the signal Cr-3.

Figure 5:
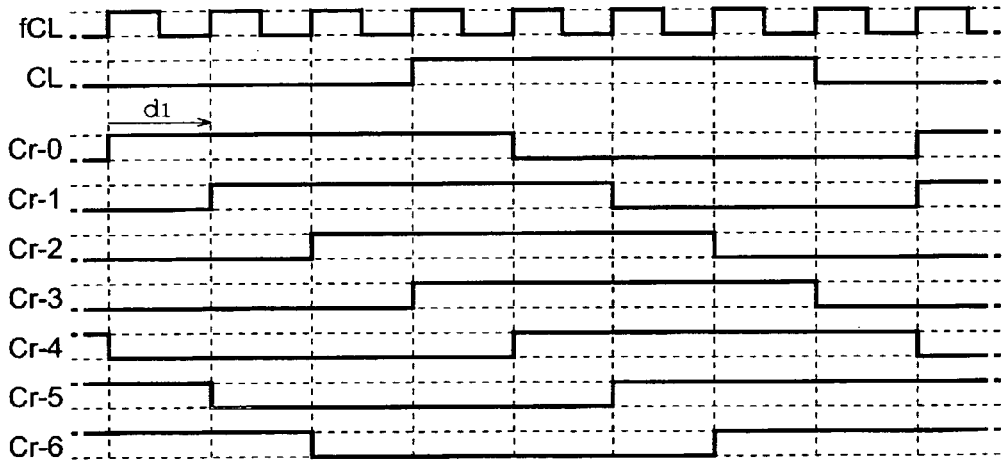
FIG. 5 is a diagram showing each delay signal by the first phase adjusting circuit.

As shown in FIG. 5, according to the present embodiment, the frequency of the clock signal fCL is set such that it is eight times the master clock signal CL. For this reason, a delay time $d_1$ by the delay circuit 2210 corresponds to $\pi/4$ of the phase of the master clock signal CL. Therefore, the signal Cr-3, which is an output of the delay circuit 2210 located in the eighth stage, becomes a signal obtained by accurately delaying the master clock signal CL by one cycle, so that the phases thereof are equal to each other.

As a result, when regarding the signal Cr-3 and the master clock signal CL as references, the phases of the signals Cr-0, Cr-1, and Cr-2 are preceded by $3\pi/4$, $\pi/2$, and $\pi/4$, respectively. In addition, the phases of the signals Cr-4, Cr-5, and Cr-6 are delayed by $\pi/4$, $\pi/2$, and $3\pi/4$, respectively.

Next, the structure of the second phase adjusting circuit 222 will be described with reference to FIG. 6.

Figure 6:
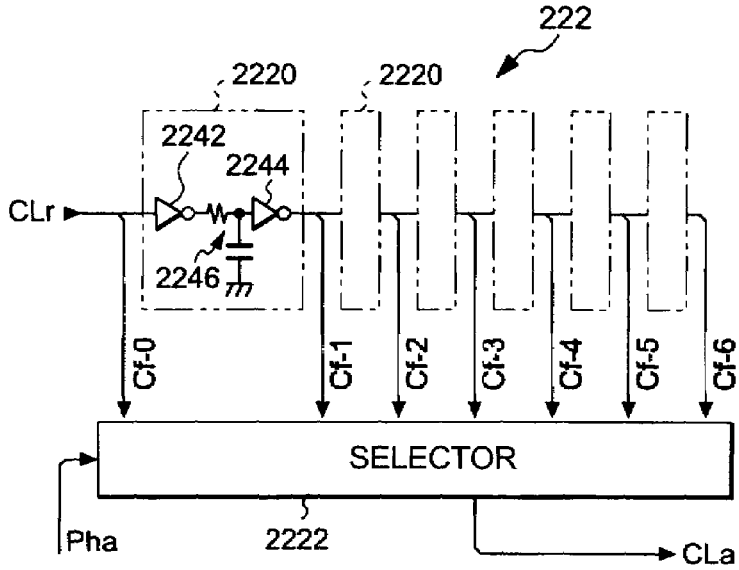
FIG. 6 is a diagram showing the structure of a second phase adjusting circuit in the electro-optical device.

In FIG. 6, each of delay circuits 2220 has NOT circuits 2242 and 2244 and an integration circuit 2246. The NOT circuit 2242 logically inverts the input signal to output it. However, since the waveform of the output signal of the NOT circuit 2242 becomes dull by the integration circuit 2246, a signal whose waveform is shaped by the NOT circuit 2244 is delayed with respect to the input signal of the NOT circuit 2242. According to the present embodiment, the delay circuits 2220 are connected to each other in a cascaded manner by six stages, and in detail, the delay circuits 2220 are connected to each other in a cascaded manner such that the output signal of the delay circuit 2220 located in a certain stage becomes an input signal of the delay circuit 2220 located in the next stage.

In the cascaded connection, an input terminal of a first stage of delay circuit 2220 is supplied with the signal CLr by the first phase adjusting circuit 221. In addition, signals Cf-1 to Cf-6 are respectively output from output terminals of the delay circuits 2220 in the first to sixth stages and are supplied to a selector 2222. However, the signal CLr is also supplied to the selector 2222 as an output signal Cf-0 having no delay.

The selector 2222 selects any one of the signals Cf-0 to Cf-6 according to a control signal Pha by the adjustment control circuit 230 and supplies it to the enable pulse generating circuit 224 as the signal CLa. In addition, in an initial state, the selector 2222 selects the signal Cf-0.

Figure 7:
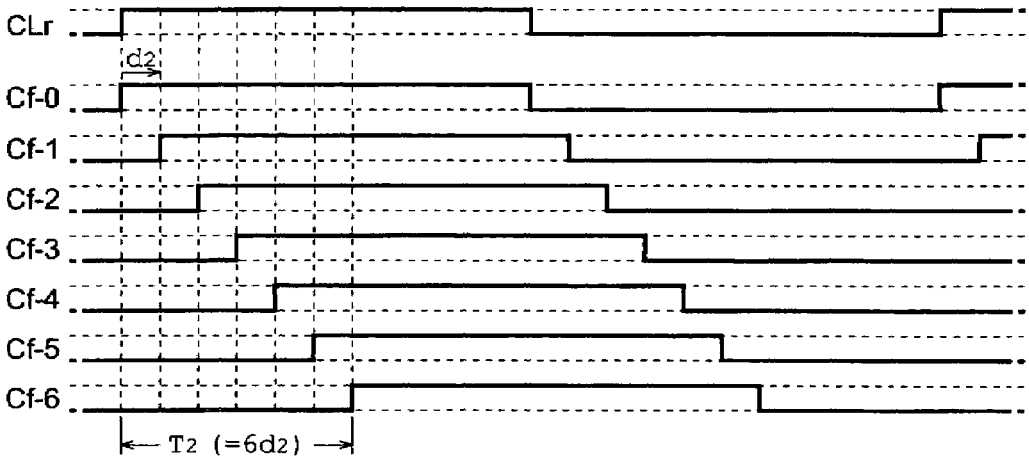
FIG. 7 is a diagram showing each delay signal by the second phase adjusting circuit.

As shown in FIG. 7, the signals Cf-0 to Cf-6 become signals obtained by gradually delaying the signal CLr by a delay time $d_2$ determined by a time constant of the integration circuit 2246 or constituent transistors of the NOT circuits 2242 and 2244.

According to the present embodiment, the delay circuits 2220 are designed such that the relationships $d_2 \leqq d_1/2$ and $6d_2 \geqq d_1$ are satisfied. Specifically, the delay time $d_2$ of the delay circuit 2220 is not more than half of the delay time $d_1$ of the delay circuit 2210. In addition, it is set that the time $6d_2$ ($=T_2$) corresponding to the phase adjustment range in the second phase adjusting circuit 222 is more than the delay time $d_1$ of the delay circuit 2210.

Figure 8:
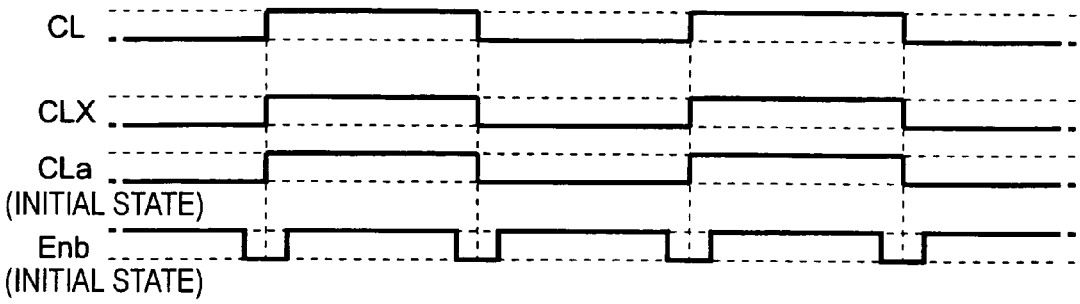
FIG. 8 is an explanatory view illustrating a clock signal of the electro-optical device.

The relationships among the master clock signal CL, the clock signal CLX, the signal CLa, and the enable pulse Enb will be described with reference to FIG. 8.

The scanning control circuit 212 outputs the master clock signal CL as the clock signal CLX as it is, as described above.

In the initial state, the selector 2212 selects the signal Cr-3, and the selector 2222 selects the signal Cf-0. As a result, the phases (and the timings) of the signal CLa and the clock signal CLX are equal to each other.

As described above, the enable pulse Enb is generated by the enable pulse generating circuit 224 such that the pulse width of the H level is shorter than half the cycle of the clock signal CLa, and such that the period becoming the L level includes the rising or falling portion of the clock signal CLa.

Therefore, the waveform of the enable pulse Enb in the initial state becomes a waveform that an interval becoming the L level synchronizes with not only the signal CLa but also the clock signal CLX.

Next, the operation of an electro-optical device will be described. First, a state in which the enable pulse Enb is not delayed with respect to the clock signal CLX is assumed.

In the display operation of the electro-optical device, FIG. 9 is a timing chart for describing the vertical scanning, FIG. 10 is a timing chart for describing the horizontal scanning, and FIG. 11 is a diagram showing an example of a voltage waveform of a data signal supplied over the continuous horizontal scanning period.

At an initial interval of the vertical effective display period, the transmission start pulse DY is supplied to the scanning driving circuit 130. As shown in FIG. 9, by supplying the transmission start pulse DY to the scanning line driving circuit 130, scanning signals G1, G2, G3, . . . , and Gm become the H level sequentially and exclusively, so that they are respectively output to the scanning lines 112. Here, first, the horizontal scanning period when the scanning signal G1 becomes the H level will be considered.

The horizontal scanning period is divided into the horizontal retrace period and the horizontal display period subsequent to the horizontal retrace period. During the horizontal effective display period, the image data Vid supplied in synchronization with the horizontal scanning is first distributed to six channels by the S/P conversion circuit 310 to be expanded by six times along a time axis, is second converted into the analog signals by the D/A converting circuit group 320, and is third converted into the original polarity state by the amplifying/inverting circuit 330 using the voltage Vc as the reference so as to correspond to the positive polarity writing to be output. As a result, the voltages of the data signals Vid1 to Vid6 by the amplifying/inverting circuit 330 become higher than the voltage Vc as the brightness of the pixel becomes black.

On the other hand, as shown in FIG. 10, during the horizontal effective display period when the scanning signal G1 becomes the H level, since the shift register 142 receives the transmission start pulses DX by using the clock signal CLX to sequentially shift them, the signals Sa1, Sa2, Sa3, . . . , and San become the H level sequentially.

Here, since the case in which the enable pulse Enb is not delayed with respect to the clock signal CLX is considered, the enable pulse Enb is as shown in FIG. 10. For this reason, the pulse widths of the signals Sa1, Sa2, Sa3, . . . , and San becoming the H levels become smaller by the enable pulse Enb and the signals Sa1, Sa2, Sa3, . . . , and San are output as the sampling signals S1, S2, S3, S(n-1), . . . , and Sn.

During the horizontal effective scanning period when the scanning signal G1 becomes the H level, when the sampling signal S1 becomes the H level, the corresponding signal among the data signals Vid1 to Vid6 is sampled to each of the six data lines 114 belonging to the first block by counting the data lines from the left side of the corresponding figure. In addition, the sampled data signals Vid1 to Vid6 are respectively applied to the pixel electrodes 118 of the pixels where the first row of scanning line 112 by counting the scanning lines from the upper side of FIG. 2 and the corresponding six data lines 114 (the first to sixth rows of data lines by counting the data lines from the left side) intersect each other.

After that, when the sampling signal S2 becomes the H level, the corresponding signal among the data signals Vid1 to Vid6 is sampled to each of the six data lines 114 belonging to the second block by counting the data lines from the left side of the corresponding figure. In addition, the sampled data signals Vid1 to Vid6 are respectively applied to the pixel electrodes 118 of the pixels where the first row of scanning line 112 and the corresponding six data lines 114 (seventh to twelfth rows of data lines by counting the data lines from the left side) intersect each other.

According the above-mentioned manner, when the sampling signals S3, S4, . . . , and Sn becomes the H level sequentially, the corresponding signal among the data signals Vid1 to Vid6 is sampled to each of the six data lines 114 belonging to any one of the third block, the fourth block, . . . , and the n-th block. In addition, the sampled data signals Vid1 to Vid6 are respectively applied to the pixel electrodes 118 of the pixels where the first row of scanning line 112 and the corresponding six data lines 114 intersect each other. As a result, the writing is completed with respect to all the pixels corresponding to the first row.

Subsequently, the period when the scanning signal G2 becomes the H level will be described. According to the present embodiment, since the polarity inverting is performed for each scanning line as described above, the negative writing is performed during the horizontal effective display period.

On the other hand, the image data Vid designates the color of the pixel as black during the horizontal retrace period, but the positive polarity writing is performed during the horizontal effective display period right before the horizontal retrace period. As a result, as shown in FIG. 11, when applied to the pixel electrode 118 of the pixel 110, each voltage of the data signals Vid1 to Vid6 is changed from the positive polarity voltage Vb(+) for making the color of the corresponding pixel the black color having the lowest gray-scale level to the negative polarity voltage Vb(−) for making the color of the corresponding pixel the black color having the lowest gray-scale level.

In addition, the relationships between voltages in FIG. 11 will be described. Here, voltages Vw(−) and Vg(−) are negative polarity voltages for making the color of the corresponding pixel the white color having the highest gray-scale level and the gray color having the intermediate gray-scale level, respectively, when applied to the pixel electrode 118 of the pixel 110. On the other hand, voltages Vw(+) and Vg(+) are positive polarity voltages for making the color of the corresponding pixel the white color having the highest gray-scale level and the gray color having the intermediate gray-scale level, respectively, when applied to the pixel electrode 118 of the pixel 110, and when the voltage Vc is used as the reference, the voltages Vw(+) and Vg(+) are symmetrical with the voltages Vw(−) and Vg(−). For the relationships of the voltages of the scanning signals G1, G2, G3, . . . , and Gm, the L levels of the scanning signals are lower than the voltage Vb(−) and the H levels of the scanning signals are higher than the voltage Vb(+).

The operation of the horizontal effective display period when the scanning signal G2 becomes the H level is the same as that in the horizontal effective display period when the scanning signal G1 becomes the H level. Specifically, the sampling signals S1, S2, S3, . . . , and Sn become the H level sequentially, so that the writing is completed with respect to all the pixels corresponding to the second row. However, since the negative polarity writing is performed during the horizontal effective display period when the scanning signal G2 becomes the H level, the amplifying/inverting circuit 330 inverts the polarities of the signals which are distributed to six channels and which are expanded by six times along a time axis using the voltage Vc as the reference so as to correspond to the negative polarity writing to output them. For this reason, as shown in FIG. 11, the voltages of the data signals Vid1 to Vid6 become smaller than the voltage Vc as the brightness of the pixel becomes black.

Similar to the above-mentioned manner, the scanning signals G3, G4, . . . , and Gm become the H levels, so that the writing is performed with respect to the third, fourth, . . . , and m-th rows of pixels. Thereby, the positive polarity writing is performed with respect to the pixels in odd numbers of rows, and the negative polarity writing is performed with respect to the pixels in even numbers of rows. As a result, the writing is completed with respect to all the pixels in the first to m-th rows during one vertical scanning period.

In addition, the voltages of the data signals Vid1 to Vid6 are changed from the voltage Vb(+) to the voltage Vb(−) in the case of the transition from the horizontal effective display period of the positive polarity writing to the horizontal effective display period of the negative polarity writing, and are changed from the voltage Vb(−) to the voltage Vb(+) in the case of the transition from the horizontal effective display period of the negative polarity writing to the horizontal effective display period of the positive polarity writing.

In addition, in the next vertical scanning period, the same writing is performed. However, at this time, the writing polarity with respect to the pixels in each row is changed. In other words, in the next vertical scanning period, the negative polarity writing is performed with respect to the pixels in the uneven-numbered rows, and the positive polarity writing is performed with respect to the pixels in the even-numbered rows.

In this manner, since the writing polarity with respect to the pixels for each vertical scanning period is changed, it is not necessary that a direct current component be applied to the liquid crystal layer 105. Therefore, it is possible to prevent the liquid crystal layer 105 from deteriorating.

On the other hand, the various signals, such as the data signals Vid1 to Vid6 and the signal Ma/Enb, are output from the processing circuit 50 according to the set timings. In addition, the various signals are supplied from the processing circuit 50 to the panel 100 through the FPC substrate. At this time, it is considered that the difference between copper foil patterns is generated, but the timing deviation of the specific signal can be ignored in the FPC substrate.

However, since wiring lines are provided on a glass substrate in the panel 100, the resistivity or parasitic capacitance is relatively large as compared to the FPC substrate. In addition, in the panel 100, signal supplying paths of the signal Ma/Enb and the data signals Vid1 to Vid6 are different from each other.

For this reason, although the timings are equal to each other when inputting the signals to the panel 100, the inside of the panel 100 shows a tendency that the phase deviation of the enable pulses Enb included in the signal Ma/Enb is generated with the supplying timings of the data signals Vid1 to Vid6.

Figure 12A:
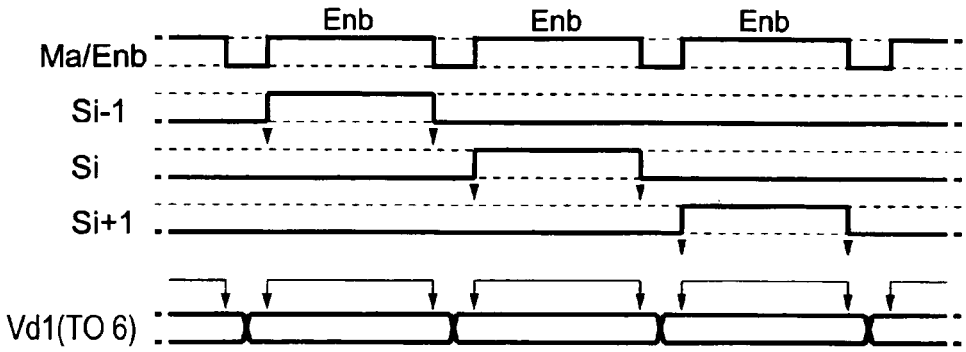
FIG. 12 is an explanatory view illustrating the phase deviation of an enable pulse in the electro-optical device.
Figure 12B:
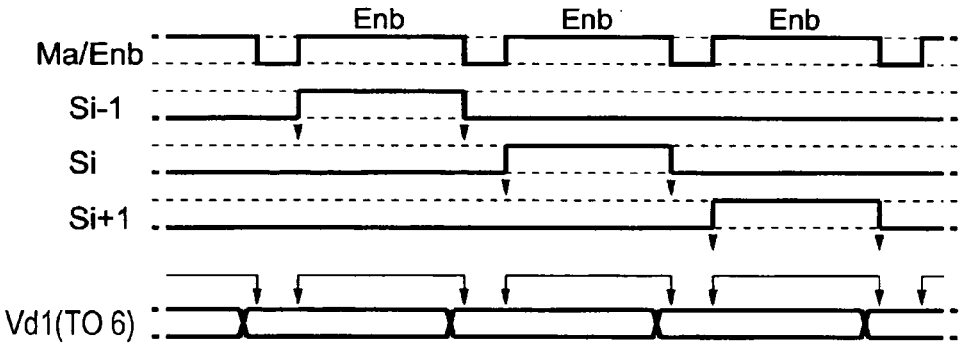
Figure 12C:
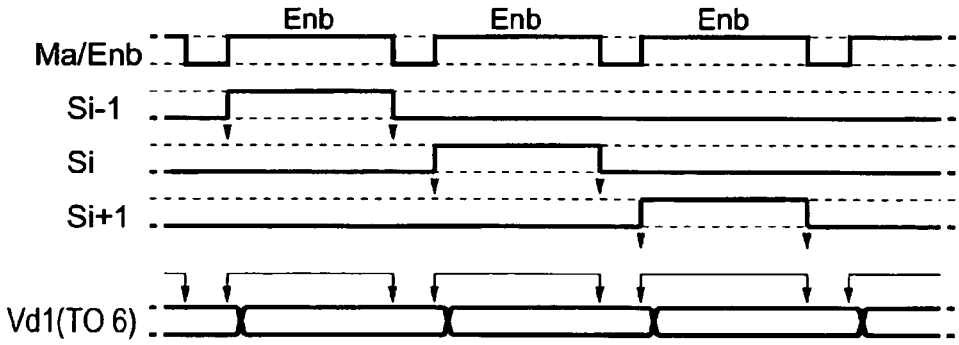

In addition, when the phase of the enable pulses Enb is delayed with respect to the supplying timings of the data signals Vid1 to Vid6 in the panel 100 as shown in FIG. 12B, in the data lines 114, the data signal corresponding to the original pixel is sampled, and then a data signal corresponding to a different pixel is sampled. As a result, the display quality is greatly degraded. On the contrary, when the phase of the enable pulses Enb is preceded with respect to the supplying timings of the data signals Vid1 to Vid6 in the panel 100 as shown in FIG. 12C, in the data lines 114, the data signal corresponding to a different pixel from the original pixel is sampled before the data signal corresponding to the original pixel is sampled. As a result, this results in a state in which the time for sampling the original pixel is not obtained, degrading the display quality.

Further, FIG. 12A shows an ideal state in which the supplying timings of the enable pulses Enb are equal to the supplying timings of the data signals Vid1 to Vid6.

The present embodiment has the structure in which the phase difference detecting circuit 180 detects how much the phase of the enable pulse Enb is deviated with respect to the supplying timings of the data signals Vid1 to Vid6, and in which the phase of the enable pulse Enb is preceded or is delayed according to the detected result.

However, the rising and falling timings of the enable pulse Enb are not equal to those of the clock signal CLX, and the data signals Vid1 to Vid6 are also analog signals. As a result, it is difficult to directly detect the phase deviation of the enable pulse Enb with respect to the supplying timings of the data signals Vid1 to Vid6.

Therefore, the present embodiment has the structure in which, during the horizontal retrace period, the signal synchronizes with the clock signal CLX, the reference pulse Ref corresponding to half the cycle is supplied as a monitoring pulse Ma to the pulse signal line 143 to which the enable pulse Enb is supplied, the same reference pulse Ref is also supplied to the monitoring signal line 173 adjacent to the image signal line 171, the phase difference between the monitoring pulse Ma and the reference pulse Ref is detected in the panel 100, and the phase deviation of the enable pulse Enb is indirectly detected with respect to the supplying timings of the data signals Vid1 to Vid6.

The structure will be described later in detail. When the reference pulse Ref is supplied to one end of the monitoring signal line 173 functioning as the input side, the delay which is the same as those of the data signals Vid1 to Vid6 is generated at the source of the TFT 184 functioning as the other end of the corresponding monitoring signal line 173. In addition, when the monitoring pulse Ma is supplied to one end of the pulse signal line 143 functioning as the input side, the delay which is the same as that of the enable pulse Enb is generated at one of the input terminals of the AND circuit 182 located at the other end side of the corresponding pulse signal line 143. As a result, the phase deviation of the enable pulse Enb with respect to the supplying timings of the data signals Vid1 to Vid6 can be determined by the deviation amount of the monitor pulse Ma with respect to the reference pulse Ref as described below.

Figure 13:
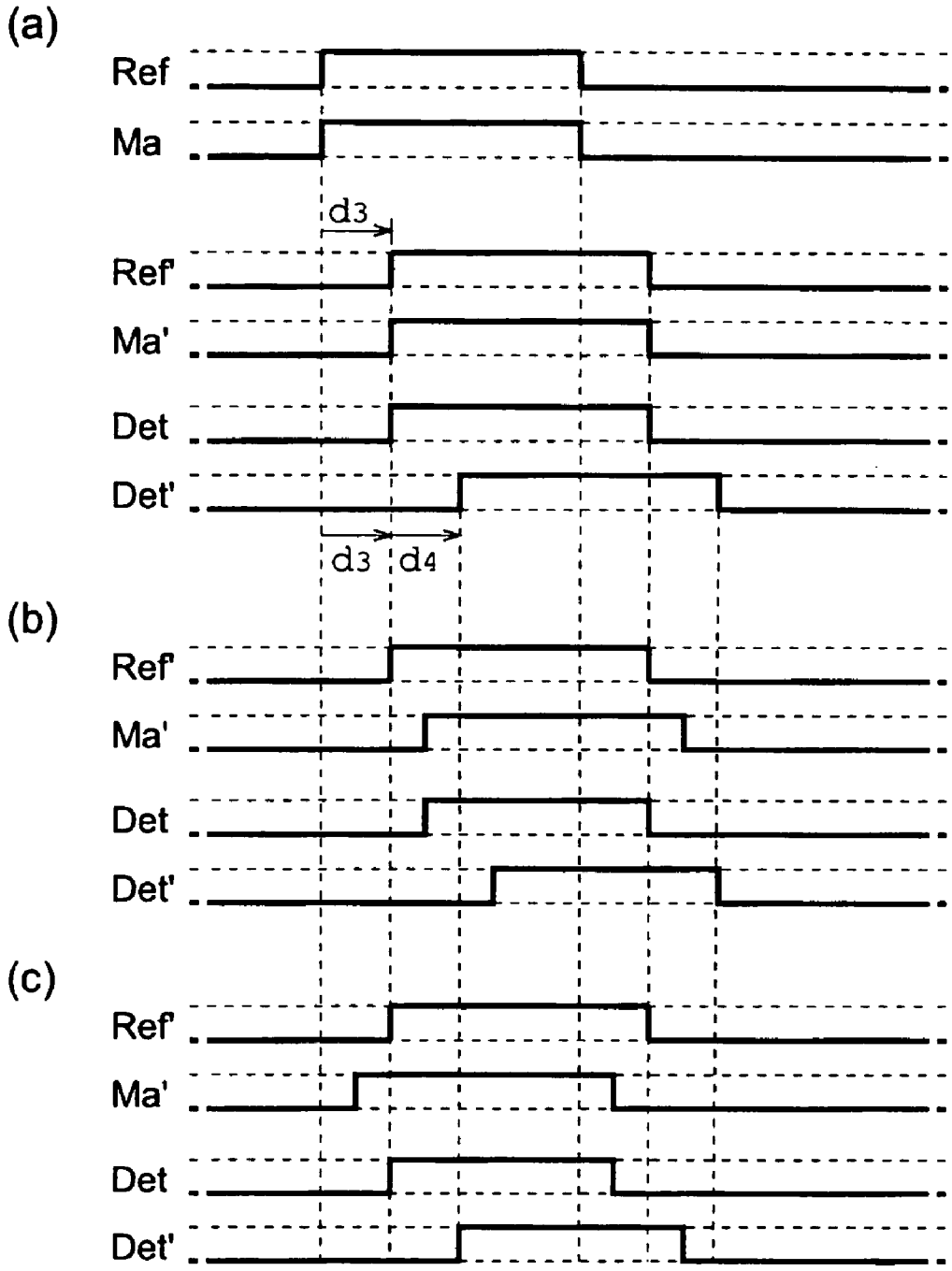
FIG. 13 is an explanatory view illustrating the relationship between the enable pulse and a detecting pulse in the electro-optical device.

For example, as shown in FIG. 13A, at the time when the signal is input to the panel 100, in the case in which the phases of the reference pulse Ref and the monitoring pulse Ma are equal to each other, if the delayed amounts of the reference pulse Ref and the monitoring pulse Ma in the panel 100 are equal to each other, a reference pulse Ref' reaching the source of the TFT 184 and a monitoring pulse Ma' reaching one end of the input terminals of the AND circuit 182 are commonly delayed by a delay time $d_3$. As a result, although the signal Det detected right after it is output to the drain of the TFT 184 is more delayed than the reference pulse Ref and has the same pulse width (half the cycle of the clock signal CLX).

The detected signal Det is fed back to the adjustment control circuit 230 in the processing circuit 50. However, at the time when the adjustment control circuit 230 receives the detected signal Det (signal Det' in FIG. 13), the detected signal Det is more delayed by a delay time $d_4$ than the waveform right after it is output to the drain of the TFT 184. However, the pulse width of the detected signal Det is received in the adjustment control circuit 230 in a state in which it is stored irrespective of the delay. As a result, if the signal Det' is shifted to the H level and the pulse width of the signal Det' (H level) is equal to the pulse width of the reference pulse Ref (half the cycle of the clock signal CLX) at the time when a time ($d_3$+$d_4$) passes after the reference pulse Ref is transmitted to the panel 100, it is determined by the adjustment control circuit 230 that the phase of the enable pulse Enb in the panel 100 is not deviated with respect to the data signals Vid1 to Vid6.

In addition, since the time $d_3$ and the time $d_4$ are values particular to the panel and are value not to be changed, the delayed time is experimentally calculated to be stored, so that the adjustment control circuit 230 may use the stored values upon the determination.

In addition, since the scanning control circuit 212 notifies the purport that the reference pulse Ref is output, the adjustment control circuit 230 can determine the state of the signal Det' at the time when the time ($d_3$+$d_4$) passes after the notification is received.

On the other hand, when the phase of the enable pulse Enb is delayed with respect to the data signals Vid1 to Vid6 in the panel 100, the phase of the monitoring pulse Ma' is further delayed with respect to the reference pulse Ref' as shown in FIG. 13B. The front end of the detected signal Det right after it is output to the drain of the TFT 184 is shorter by the delayed monitoring pulse Ma' than the reference pulse Ref'. After that, the detected signal Det is delayed by the time $d_4$ and is received in the adjustment control circuit 230 in a state in which the pulse width thereof is maintained. As a result, if the signal Det' is in the L level at the time when the time ($d_3$+$d_4$) passes after the reference pulse Ref is transmitted to the panel 100, it is determined by the adjustment control circuit 230 that the phase of the enable pulse Enb in the panel 100 is delayed with respect to the data signals Vid1 to Vid6. In addition, the adjustment control circuit 230 can calculate the delayed amount of the enable pulse Enb by how much the pulse width of the signal Det' is shortened with respect to the pulse width of the reference pulse Ref when the signal Det' becomes the H level after the corresponding time.

In addition, when the phase of the enable pulse Enb is preceded with respect to the data signals Vid1 to Vid6 in the panel 100, the monitoring pulse Ma' temporally precedes the reference pulse Ref'. As a result, the rear end of the detected signal Det right after it is output to the drain of the TFT 184 is shortened by the monitoring pulse Ma' preceding the reference pulse Ref'. After that, the detected signal Det is delayed by the time $d_4$ and is received to the adjustment control circuit 230 in a state in which the pulse width thereof is maintained. As a result, if the signal Det' is shifted to the H level, and the pulse width of the signal Det' (H level) is shorter than the pulse width of the reference pulse Ref at the time when the time ($d_3$+$d_4$) passes after the reference pulse Ref is transmitted to the panel 100, it is determined by the adjustment control circuit 230 that the phase of the enable pulse Enb in the panel 100 is preceded with respect to the data signals Vid1 to Vid6. In addition, the adjustment control circuit 230 can calculate the preceded amount of the enable pulse Enb by how much the pulse width of the signal Det' is shortened with respect to the pulse width of the reference pulse Ref when the signal Det' becomes the H level after the corresponding time.

The enable pulse Enb is generated by the enable pulse generating circuit 224 using the signal CLa as the reference. However, the phase of the signal CLa with respect to the master clock signal CL (clock signal CLX) is roughly adjusted by the first phase adjusting circuit 221 and is minutely adjusted by the second phase adjusting circuit 222. Therefore, the phase of the enable pulse Enb may roughly adjusted by the first phase adjusting circuit 221 and may be minutely adjusted by the second phase adjusting circuit 222. In addition, since the adjustment by the first phase adjusting circuit 221 and the second phase adjusting circuit 222 is controlled by the adjustment control circuit 230, the phase of the enable pulse Enb is controlled by the adjustment control circuit 230.

Figure 14:
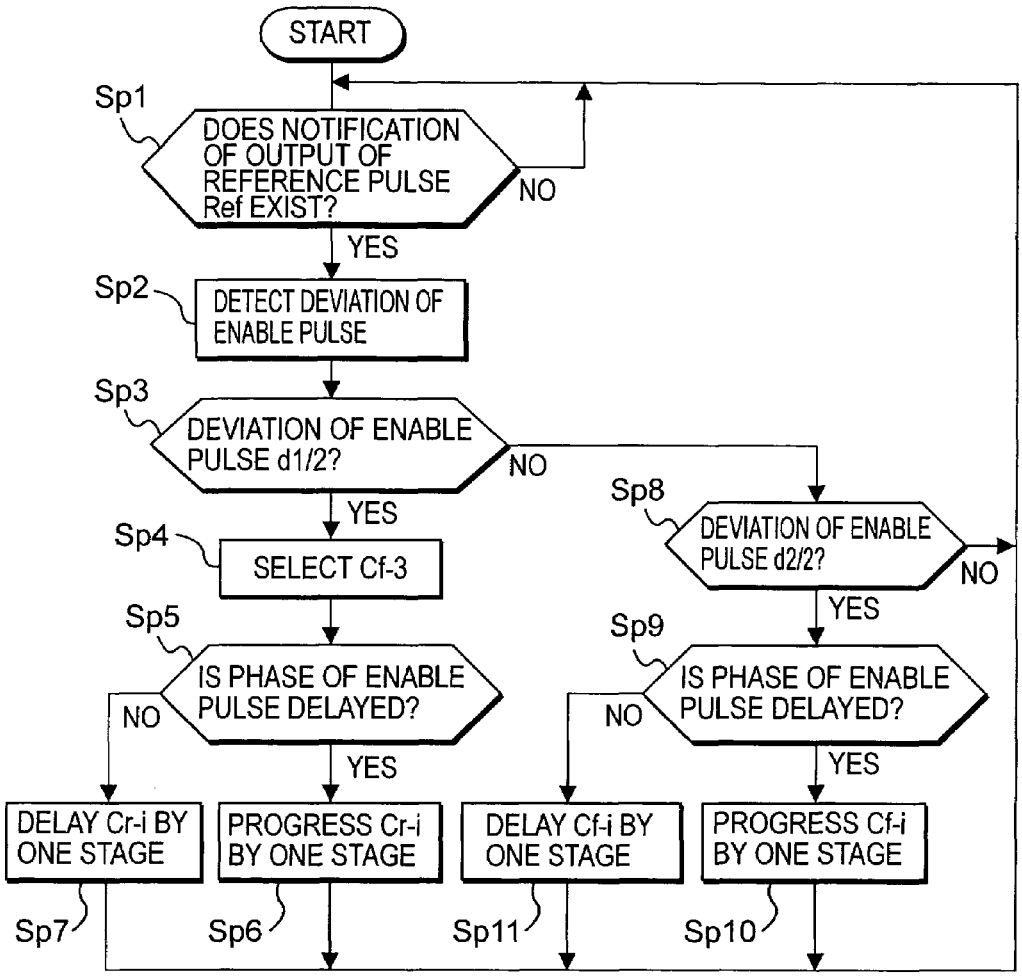
FIG. 14 is a flow chart illustrating a phase adjustment operation of the electro-optical device.

The phase control of the enable pulse Enb by the phase control circuit 230 will now be described. FIG. 14 is a flowchart illustrating the operation of the phase control.

First, the adjustment control circuit 230 determines whether the notification indicating that the reference pulse Ref is output from the scanning control circuit 212 is received (step Sp1) and waits until the determination result is 'Yes'.

When the notification is received, the adjustment control circuit 230 detects the deviation of the enable pulse Enb with respect to the data signals Vid1 to Vid6 from the state and pulse width of the signal Det' at the time when the time ($d_3$+$d_4$) passes after the notification is received as described above (step Sp2).

Next, the adjustment control circuit 230 determines whether the detected deviation of the enable pulse Enb is more than half of the time $d_1$ (step Sp3). In other words, the adjustment control circuit 230 determines whether the phase of the enable pulse Enb is preceded by half of the delayed time $d_1$ or is delayed.

When the determination result is 'No', the phase adjustment by the first phase adjusting circuit 221 is not necessary, so that the process is skipped into step Sp8. On the other hand, when the determination result is 'Yes', the phase adjustment by the first phase adjusting circuit 221 is necessary. As a result, the phase control circuit 230 outputs the control signal Pha instructing the purport related to the selection of the signal Cf-3 to the selector 2222 in the second phase control circuit 222 (step Sp4). Therefore, the selector 2222 actually selects the signal Cf-3. As a result, the adjustment point in the second phase adjusting circuit 222 is set as almost the center of the adjustment range.

Next, the adjustment control circuit 230 determines whether the enable pulse Enb is delayed with respect to the data signals Vid1 to Vid6 or is preceded with respect to it (step Sp5). When the phase of the enable pulse Enb is delayed with respect to the data signals Vid1 to Vid6, the determination result becomes 'Yes'. As a result, the adjustment control circuit 230 instructs the selector 2212 in the first phase adjusting circuit 221 through the control signal Phd that the selector 2212 selects the signal whose phase is more preceded by one stage than that of the selection signal of the current time (step Sp6). Thereby, the phase of the selected signal is actually preceded by one stage in the selector 2212.

On the other hand, when the phase of the enable pulse Enb is preceded with respect to the data signals Vid1 to Vid6, the determination result in the step Sp5 becomes 'No'. As a result, the adjustment control circuit 230 instructs the selector 2212 in the first phase adjusting circuit 221 through the control signal Phd that the selector 2212 selects the signal whose phase is more delayed by one stage than that of the selection signal of the current time (step Sp7). Thereby, the phase of the selected signal is actually delayed by one stage in the selector 2212.

When step Sp6 or step Sp7 is completed, the adjustment control circuit 230 returns the process to step Sp1. This is because, in steps Sp6 and Sp7, the phase of the signal CLr is changed by the amount corresponding to the time $d_1$ and although the phase is changed, the deviation of the enable pulse Enb with respect to the data signals Vid1 to Vid6 may be more than half of the time $d_1$.

For this reason, the process returns to step Sp1 after step Sp6 or step Sp7. When the determination result in step Sp3 is 'Yes', the rough adjustment of the phase through step Sp6 or step Sp7 is performed again. On the other hand, when the determination result in step Sp3 is 'No', the minute adjustment by the second phase adjusting circuit 222 is performed.

In other words, when the determination result of step Sp3 is 'No', that is, when the deviation of the enable pulse Enb with respect to the data signals Vid1 to Vid6 is smaller than half of the time $d_1$, the adjustment control circuit 230 determines whether the deviation amount is more than half of the time $d_2$ (step Sp8). Specifically, the adjustment control circuit 230 determines whether the phase of the enable pulse Enb is more preceded or delayed than the amount corresponding to half of the delay time $d_2$ of the delay circuit 2220 in the second phase adjusting circuit 222.

When the determination result of step Sp8 is 'Yes', the minute adjustment of the phase by the second phase adjusting circuit 222 is necessary, so that the adjustment control circuit 230 determines whether the deviation of the enable pulse Enb is delayed or preceded with respect to the data signals Vid1 to Vid6 (step Sp9).

When the phase of the enable pulse Enb is delayed with respect to the data signals Vid1 to Vid6, the determination result becomes 'Yes'. As a result, the adjustment control circuit 230 instructs the selector 2222 in the second phase adjusting circuit 222 through the control signal Pha that the selector 2222 selects the signal whose phase is more preceded by one stage than that of the selection signal of the current time (step Sp10). Thereby, the phase of the selected signal is actually preceded by one stage in the selector 2222.

On the other hand, when the phase of the enable pulse Enb is preceded with respect to the data signals Vid1 to Vid6, the determination result of step Sp9 becomes 'No'. As a result, the adjustment control circuit 230 instructs the selector 2222 in the second phase adjusting circuit 222 through the control signal Pha that the selector 2222 selects the signal whose phase is more delayed by one stage than that of the selection signal of the current time (step Sp11). Thereby, the phase of the selected signal is actually delayed by one stage in the selector 2222.

When step Sp10 or step Sp11 is completed, the adjustment control circuit 230 returns the process to step Sp1 again, and the processes of steps Sp8 to Sp11 are repeated according to the deviation of the enable pulse Enb via steps Sp1, Sp2, and Sp3. In the repeated process, when the determination result of step Sp8 is 'No', this means that the deviation of the enable pulse Enb is smaller than half of the time $d_1$, that is, the deviation is small by which the control is not necessary. Therefore, the display quality by the deviation can be ignored.

In addition, when the determination result of step Sp8 is 'No', the adjustment control circuit 230 returns the process to step Sp1. As a result, when the deviation becomes large due to a certain factor, such as temperature change, the phase adjustment is performed again so as to eliminate the deviation. Specifically, when the deviation is large, the minute adjustment through steps Sp10 and Sp11 is performed after the rough adjustment through step Sp6 and Sp7. On the other hand, when the deviation is small, the minute adjustment through steps Sp10 and Sp11 is performed. As a result, the phase adjustment is performed such that the deviation is removed.

According to the present embodiment, the phase of the enable pulse Enb is roughly adjusted by the first phase adjusting circuit 221 and is then minutely adjusted by the second phase adjusting circuit 222. As a result, although the adjustment accuracy in the first phase adjusting circuit 221 is rough, the adjustment accuracy can be ensured by the minute adjustment in the second phase adjusting circuit 222. In addition, since the adjustment range in the second phase adjusting circuit 222 decreases, it is possible to prevent the structure of the circuit from being complicated.

In addition, the phase adjustment of the enable pulse Enb is performed during the horizontal retrace period, and the phase is not changed during the effective display period. Therefore, it is possible to prevent the degradation of display quality caused by the change of the phase of the enable pulse Enb.

In addition, according to the present embodiment, before the rough adjustment by the first phase adjusting circuit 221, in the second phase adjusting circuit 222, the signal Cf-3 is selected, and the phase adjustment point is set to a central point. Therefore, after the rough adjustment, the adjustment accuracy can be ensured only by the minute adjustment by the second phase adjusting circuit 222.

In addition, in the above-mentioned embodiment, the rough adjustment or minute adjustment is changed in a stepwise manner. However, the deviation of the enable pulse Enb with respect to the data signals Vid1 to Vid6 can be detected from the signal Det'. Therefore, after the first phase adjusting circuit 221 changes the rough adjustment by the number of stages according to the corresponding deviation, the second phase adjusting circuit 222 may change the minute adjustment by the number of stages corresponding to the amount which is not adjusted in the rough adjustment.

In addition, in the above-mentioned embodiment, the first phase adjusting circuit 221 and the second phase adjusting circuit 222 have the structures shown in FIGS. 4 and 6, respectively. However, if the adjustment accuracy in the second phase adjusting circuit 222 is minuter than the adjustment accuracy in the first phase adjusting circuit 221, the present invention is not limited to the above-mentioned structures. In addition, the invention is not limited to the structure in which the signals are selected by the selectors 2212 and 2222 to adjust the phases thereof. In addition, the structure in which the delayed time is gradually or continuously changed may be used.

According to the present embodiment, the signal Ma/Enb includes the detecting monitoring pulse Ma. However, the transmission start pulse DX may be supplied to the monitoring signal line 173 as the monitoring pulse Ma. Here, when the transmission start pulse DX is used as the monitoring pulse Ma, it is necessary to change the structure such that there is a predetermined time interval until the enable pulse Enb is supplied after the transmission start pulse DX is supplied.

In addition, the deviation of the enable pulse Enb with respect to the data signals Vid1 to Vid6 may not indirectly detected. For example, in the retrace period, detecting dummy signals are inserted into the data signals Vid1 to Vid6, a detecting enable pulse synchronized with the corresponding dummy signal is generated, the detecting dummy signal and the detecting enable pulse are supplied to the panel, and the delay in the panel 100 is directly detected.

Further, according to the present embodiment, during the horizontal retrace period, the monitoring pulse Ma is output, and the phase adjustments by the first phase adjusting circuit 221 and the second phase adjusting circuit 222 are performed according to the information of the signal Det' which is the response of the output of the monitoring pulse Ma. However, the relatively long time is required until the determination result of step Sp8 becomes 'No' after the processes of steps Sp8 to Sp11 are repeatedly performed. On the other hand, the phase adjustment by the second phase adjusting circuit 222 is performed by using, as the minimum unit, the phase corresponding to the delay time $d_2$ in the delay circuit 2220. For this reason, although the phase adjustment is performed during the horizontal effective display period, the deterioration of display quality due to the phase change may be ignored. Therefore, the phase change in the second phase adjusting circuit 222 may be performed in the horizontal effective display period.

However, the phase adjustment in the first phase adjusting circuit 221 is performed by using, as the minimum unit, the phase corresponding to the delay time $d_1$ in the delay circuit 2210. For this reason, when the phase adjustment is performed during the horizontal effective display period, it is difficult to avoid the deterioration of display quality caused by the phase change. Therefore, it is preferable that the phase change in the first phase adjusting circuit 221 be performed in the horizontal retrace period or the vertical retrace period not having an influence on a display operation.

In addition, if it is preferable that the phase adjustment operation be performed during the period not having an influence on display, the corresponding phase adjustment operation may be performed for a predetermined time right after power is turned on.

In addition, in the present embodiment, the second phase adjusting circuit 222 is arranged at the rear stage of the first phase adjusting circuit 221. However, the first phase adjusting circuit 221 is arranged at the rear stage of the second phase adjusting circuit 222.

In addition, in the above-mentioned embodiment, the image data Vid is expanded to the image data Vd1*d* to Vd6*d* of the six channels. However, the number of the expanded channels is not limited to '6'. In addition, the invention is limited to the structure in which the phase is expanded, but may be applied the structure in which the pulse width of the sampling signal becomes smaller by the enable pulse Enb in a point-sequential method.

On the other hand, in the above-mentioned embodiment, the data signal supplying circuit 300 processes the digital image signal Vid, but may process analog image signals. In addition, in the data signal supplying circuit 300, the analog conversion is performed after the S/P expansion. However, when the corresponding signal is an analog signal whose final output is the same, the S/P expansion may be performed after the analog conversion.

In addition, in the above-mentioned embodiment, the normally white mode in which, when the effective voltage value between the counter electrode 108 and the pixel electrode 118 is small, white display is performed is described. However, a normally black mode for performing black display may be employed.

The above-mentioned embodiment uses TN-type liquid crystal, but may use liquid crystal of a bi-stable type and a polymer dispersion type, such as a BTN (bi-stable twisted nematic) type and a ferroelectric type, having the memory property. The above-mentioned embodiment may use liquid crystal of a GH (guest host) type obtained by dissolving dye (guest) having anisotropy in absorbing visible light in the major axis and minor axis of the molecules in liquid crystal (host) having the constant molecular arrangement and arranging the dye molecules so as to be parallel to the liquid crystal molecules.

In addition, a vertical alignment (homeotropic alignment) structure in which, when no voltage is applied, the liquid crystal molecules are arranged orthogonal to both substrates, but when a voltage is applied, the liquid crystal molecules are arranged parallel to both substrates may be employed. In addition, a parallel (horizontal) alignment (homogeneous alignment) structure in which, when no voltage is applied, the liquid crystal molecules are arranged parallel to both substrates, but when a voltage is applied, the liquid crystal molecules are arranged orthogonal to both substrates may be employed. In this way, the present embodiment can be applied to various types of liquid crystal or alignments types.

Until now, the liquid crystal device is described. However, if the present invention has the construction that the image data (image signal) is supplied through the image signal line 171, the present invention may be applied to devices using EL (electronic luminescent) elements, electron emission elements, electrophoresis elements, and digital mirror elements or plasma display devices.

<Electronic Apparatus>

Next, as an example of an electronic apparatus using the electro-optical device according to the present embodiment, a projector using the above-mentioned panel 100 as a light valve will be described.

Figure 15:
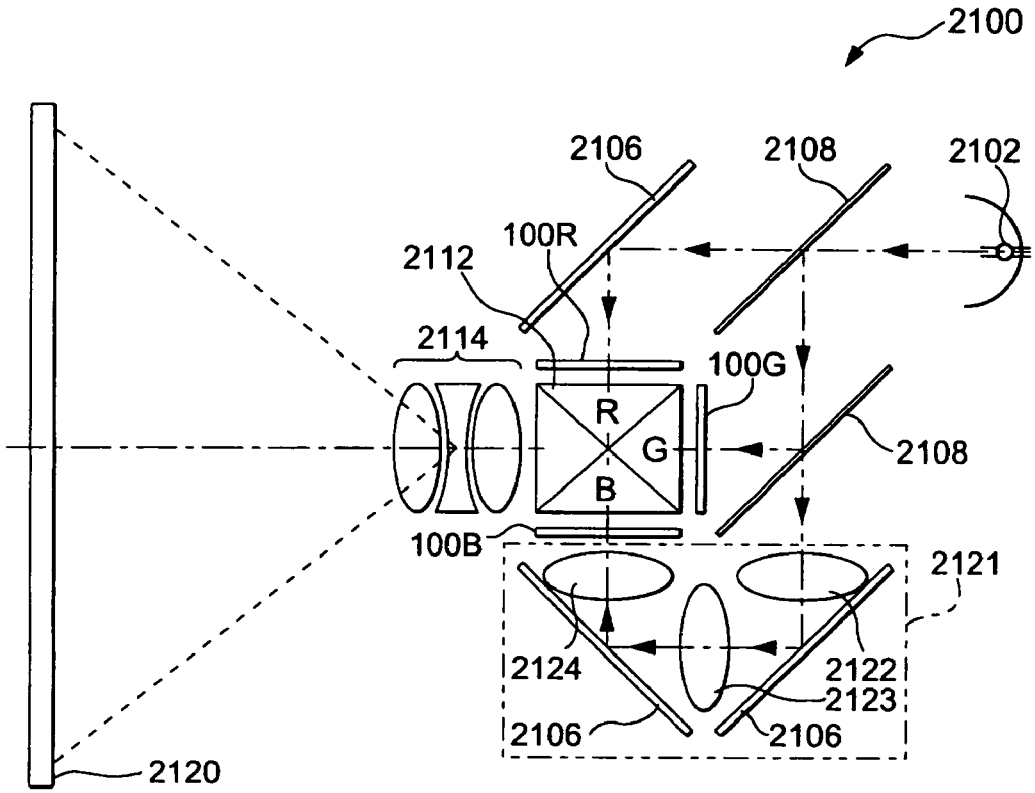
FIG. 15 is a diagram showing the structure of a projector serving as an example of an electronic apparatus to which the electro-optical device is applied.

FIG. 15 is a plan view showing the structure of a projector. As shown in FIG. 15, a lamp unit 2102 composed of a white light source, such as a halogen lamp, is provided in a projector 2100. The projection light emitted from the lamp unit 2102 is divided into the three primary colors R (red), G (green), and B (blue) by three mirrors 2106 and two dichroic mirrors 2108, and the divided light components are guided into light valves 100R, 100G, and 100B respectively corresponding to the three primary colors. In addition, since the B light component has an optical path longer than those of the R light component and the G light component, in order to prevent the loss of light, the B light component is guided through a relay lens system 2121 composed of an incident lens 2122, a relay lens 2123, and an emission lens 2124.

Here, the light valves 100R, 100G, and 100B have the same structure as that of the panel 100 according to the above-mentioned embodiment and are respectively driven by the image signals corresponding to the respective colors R, G, and B supplied from the processing circuit (not shown in FIG. 15).

The light components respectively modulated by the light valves 100R, 100G, and 100B are incident on a dichroic prism 2112 in three directions. In addition, in the dichroic prism 2112, the R and B light components are refracted at an angle of 90 degrees. On the other hand, the G light component travels straight. Therefore, after images having the respective colors are synthesized, a color image is projected onto a screen 2120 by a projection lens 2114.

In addition, since the light components corresponding to the primary colors R, G, and B are respectively incident on the light valves 100R, 100G, and 100B by the dichroic mirror 2108, it is not necessary to provide color filters. In addition, the images passing through the light valves 100R and 100B are reflected from the dichroic prism 2112 and are then projected. On the other hand, since the image passing through the light valve 100G is projected as it is, the horizontal scanning directions by the light valves 100R and 100B are opposite to the horizontal scanning direction by the light valve 100G. As a result, a mirror-reversed image is displayed.

In addition to the electronic apparatus shown in FIG. 15, the electro-optical device according to the invention can be applied to various electronic apparatuses, such as cellular phones, personal computers, TV sets, monitors of video cameras, car navigation apparatuses, pagers, electronic organizers, calculators, word processors, work stations, video phones, POS terminals, digital still cameras, and apparatuses equipped with touch panels.

What is claimed is:

1. A driving circuit of an electro-optical device, the electro-optical device including a plurality of pixels which are provided to correspond to intersections of a plurality of scanning lines and a plurality of data lines and which display the gray-scale levels corresponding to data signals sampled to the data lines when the scanning lines and the data lines are selected; a scanning line driving circuit which selects the scanning lines; shift registers which generate pulse signals for selecting the data lines for a period of time when the scanning lines are selected; a logical circuit which restricts the pulse signals respectively generated by the shift registers to the pulse width of an enable pulse to output them as sampling signals; and a sampling circuit which samples the data signals to the data lines according to the sampling signals, the driving circuit comprising:

a phase difference detecting circuit which detects the phase difference between a monitoring signal supplied in synchronization with the data signal and a reference pulse supplied in synchronization with the enable pulse and which outputs the detected result as a phase difference signal;

a first phase adjusting circuit which roughly adjusts, in a retrace period in which neither the scanning lines nor the data lines are selected, the phase of the enable pulse supplied to the logical circuit;

a second phase adjusting circuit which minutely adjusts, in an effective display period in which either the scanning lines or the data lines are selected, the phase of the enable pulse supplied to the logical circuit with higher precision than the first phase adjusting circuit; and an adjustment control circuit which, when the phase difference signal indicates that the phase of the monitoring signal is delayed with respect to the reference pulse, controls the first phase adjusting circuit to advance the phase of the enable pulse and then controls the second phase adjusting circuit to minutely adjust the phase of the enable pulse such that the phase difference indicated by the phase difference signal is minimum, and which, when the phase difference signal indicates that the phase of the monitor signal precedes that of the reference pulse, controls the first phase adjusting circuit to delay the phase of the enable pulse and then controls the second phase adjusting circuit to minutely adjust the phase of the enable pulse such that the phase difference indicated by the phase difference signal is minimum.

2. The driving circuit of an electro-optical device according to claim 1, wherein the adjustment control circuit controls the first phase adjusting circuit to perform the rough adjustment for a predetermined period after power is supplied.

3. The driving circuit of an electro-optical device according to claim 1, wherein the precision of the minute adjustment by the second phase adjusting circuit is two or more times that of the rough adjustment by the first phase adjusting circuit.

4. The driving circuit of an electro-optical device according to claim 1, wherein, when controlling the first phase adjusting circuit to perform the rough adjustment, the adjustment control circuit controls the second phase adjusting circuit such that a phase adjustment point is approximately at the center of an adjustment range.

5. The driving circuit of an electro-optical device according to claim 1, wherein the monitoring signal and the reference pulse are generated in synchronization with each other.

6. The driving circuit of an electro-optical device according to claim 1, wherein the sampling signal is supplied in synchronization with a clock signal, and the reference pulse is supplied in synchronization with the clock signal in a horizontal retrace period.

7. A driving method of an electro-optical device including a plurality of pixels which are provided to correspond to intersections of a plurality of scanning lines and a plurality of data lines and which display the gray-scale levels corresponding to data signals sampled to the data lines when the scanning lines and the data lines are selected; a scanning line driving circuit which selects the scanning lines; shift registers which generate pulse signals for selecting the data lines for a period of time when the scanning lines are selected; a logical circuit which restricts the pulse signals respectively generated by the shift registers to the pulse width of an enable pulse to output them as sampling signals; and a sampling circuit which samples the data signals to the data lines according to the sampling signals, the driving method comprising:

detecting the phase difference between a monitoring signal supplied in synchronization with the data signal and a reference pulse supplied in synchronization with the enable pulse and outputting the detected result as a phase difference signal, when the phase difference signal indicates that the phase of the monitoring signal is delayed with respect to the reference pulse, performing rough adjustment, in a retrace period in which neither the scanning lines nor the data lines are selected, to advance the phase of the enable pulse, and then performing minute adjustment, in an effective display period in which either the scanning lines or the data lines are selected, on the phase of the enable pulse such that the phase difference indicated by the phase difference signal is minimum, and when the phase difference signal indicates that the phase of the monitor signal precedes that of the reference pulse, performing the rough adjustment, in a retrace period in which neither the scanning lines nor the data lines are selected, to delay the phase of the enable pulse, and then performing the minute adjustment, in an effective display period in which either the scanning lines or the data lines are selected, on the phase of the enable pulse such that the phase difference indicated by the phase difference signal is minimum.

8. An electro-optical device comprising:

a plurality of pixels which are provided to correspond to intersections of a plurality of scanning lines and a plurality of data lines and which display gray-scale levels corresponding to data signals sampled to the data lines when the scanning lines and the data lines are selected;

a scanning line driving circuit which selects the scanning lines;

shift registers which generate pulse signals for selecting the data lines for a period of time when the scanning lines are selected;

a logical circuit which restricts the pulse signals respectively generated by the shift registers to the pulse width of an enable pulse to output them as sampling signals;

a sampling circuit which samples the data signals to the data lines according to the sampling signals, a phase difference detecting circuit which detects the phase difference between a monitoring signal supplied in synchronization with the data signal and a reference pulse supplied in synchronization with the enable pulse and which outputs the detected result as a phase difference signal;

a first phase adjusting circuit which roughly adjusts, in a retrace period in which neither the scanning lines nor the data lines are selected, the phase of the enable pulse supplied to the logical circuit;

a second phase adjusting circuit which minutely adjusts, in an effective display period in which either the scanning lines or the data lines are selected, the phase of the enable pulse supplied to the logical circuit with higher precision than the first phase adjusting circuit; and an adjustment control circuit which, when the phase difference signal indicates that the phase of the monitoring signal is delayed with respect to the reference pulse, controls the first phase adjusting circuit to advance the phase of the enable pulse and then controls the second phase adjusting circuit to minutely adjust the phase of the enable pulse such that the phase difference indicated by the phase difference signal is minimum, and which, when the phase difference signal indicates that the phase of the monitor signal precedes that of the reference pulse, controls the first phase adjusting circuit to delay the phase of the enable pulse and then controls the second phase adjusting circuit to minutely adjust the phase of the enable pulse such that the phase difference indicated by the phase difference signal is minimum.

9. An electronic apparatus comprising the electro-optical device according to claim 8.

* * * * *